US007861751B2

(12) United States Patent
McGehee

(10) Patent No.: US 7,861,751 B2
(45) Date of Patent: Jan. 4, 2011

(54) EDGE TRIMMING AND BOARD RIPPING APPARATUS AND METHOD

(75) Inventor: Ronald W. McGehee, Ukiah, CA (US)

(73) Assignee: McGehee Development Company LLC, Ukiah, CA (US)

( * ) Notice: Subject to any disclaimer, the term of this patent is extended or adjusted under 35 U.S.C. 154(b) by 718 days.

(21) Appl. No.: 11/688,076

(22) Filed: Mar. 19, 2007

(65) Prior Publication Data

US 2007/0221293 A1 Sep. 27, 2007

Related U.S. Application Data

(60) Provisional application No. 60/743,619, filed on Mar. 21, 2006.

(51) Int. Cl.
*B27M 1/08* (2006.01)

(52) U.S. Cl. ..... 144/3.1; 144/1.1; 144/2.1; 83/75.5; 83/471.3

(58) Field of Classification Search ..... 144/357, 144/118, 39, 1.1, 2.1, 3.1; 83/409, 497, 508, 83/508.1–508.3, 75.5, 471.3
See application file for complete search history.

(56) References Cited

U.S. PATENT DOCUMENTS

| | | | | |
|---|---|---|---|---|
| 1,263,443 | A | 4/1918 | Lien | |
| 3,598,005 | A * | 8/1971 | Shafer | 82/76 |
| 4,144,782 | A | 3/1979 | Lindstrom | |
| 4,239,072 | A | 12/1980 | Merilainen | |
| 4,373,563 | A | 2/1983 | Kenyon | |
| 4,440,203 | A | 4/1984 | Ostberg | |
| 4,449,557 | A | 5/1984 | Makela et al. | |
| 4,548,247 | A | 10/1985 | Eklund | |
| 4,553,652 | A | 11/1985 | Fallos | |
| 4,572,256 | A | 2/1986 | Rautio | |
| 4,815,917 | A | 3/1989 | Newnes | |
| 4,881,584 | A | 11/1989 | Wislocker et al. | |

(Continued)

FOREIGN PATENT DOCUMENTS

| | | |
|---|---|---|
| CA | 2022857 | 2/1992 |

(Continued)

OTHER PUBLICATIONS

Office Action mailed Feb. 16, 2009 for corresponding Canadian Patent Application No. 2,582,489; 3 pages.

*Primary Examiner*—Dana Ross
*Assistant Examiner*—Matthew G Katcoff
(74) *Attorney, Agent, or Firm*—James F. Hann; Haynes Beffel & Wolfeld LLP

(57) ABSTRACT

A wood product assembly includes a cutter subassembly and a skewing assembly. A cutter positioning body is movable by a slewing assembly along a slewing axis. A spindle housing is mounted to the cutter positioning body for pivotal movement about a pivot axis. A spindle, to which a cutter, such as a sawblade or chipper head, is affixed, is mounted to the spindle housing for rotation about a spindle rotation axis by a cutter driver. The skewing assembly is coupled to the spindle housing to position the spindle rotation axis to a selected angular orientation to position the cutter at a selected skew angle. In some examples the cutter driver comprises a drive source fixedly secured to a frame and an extendable length universal-joint driveline assembly.

23 Claims, 29 Drawing Sheets

U.S. PATENT DOCUMENTS

| | | | | |
|---|---|---|---|---|
| 5,056,922 | A | | 10/1991 | Cielo et al. |
| 5,123,002 | A | * | 6/1992 | Tateishi ..... 369/44.32 |
| 5,322,494 | A | * | 6/1994 | Holtey et al. ..... 483/12 |
| 5,362,970 | A | | 11/1994 | Pryor et al. |
| 5,722,474 | A | | 3/1998 | Raybon et al. |
| 5,761,979 | A | | 6/1998 | McGehee |
| 5,816,302 | A | | 10/1998 | Newnes |
| 5,853,038 | A | | 12/1998 | Newnes |
| 5,870,936 | A | * | 2/1999 | McGehee ..... 83/13 |
| 5,884,682 | A | | 3/1999 | Kennedy et al. |
| 5,930,908 | A | * | 8/1999 | Patrisso et al. ..... 33/600 |
| 5,946,995 | A | | 9/1999 | Michell et al. |
| 6,178,858 | B1 | | 1/2001 | Knerr et al. |
| 6,612,216 | B2 | | 9/2003 | McGehee et al. |
| 6,688,351 | B2 | * | 2/2004 | Stager et al. ..... 144/373 |
| 6,991,012 | B2 | | 1/2006 | Mitchell et al. |
| 2002/0152861 | A1 | * | 10/2002 | Conry ..... 83/56 |
| 2003/0019545 | A1 | * | 1/2003 | Woodford et al. ..... 144/357 |
| 2005/0011328 | A1 | * | 1/2005 | McGehee et al. ..... 83/523 |

FOREIGN PATENT DOCUMENTS

| | | |
|---|---|---|
| CA | 2386394 | 4/2001 |
| WO | 0123153 | 4/2001 |

* cited by examiner

EDGE TRIMMING AND BOARD RIPPING APPARATUS AND METHOD

CROSS-REFERENCE TO OTHER APPLICATIONS

This application claims the benefit of provisional patent application No. 60/743,619, filed 21 Mar. 2006, having the same title, the disclosure of which is incorporated by reference.

FEDERALLY SPONSORED RESEARCH OR DEVELOPMENT

None.

BACKGROUND OF THE INVENTION

Many trees do not grow straight so that the logs cut from the trees are swept or curved in shape. Special procedures and equipment must be used to maximize the board feet of lumber cut from these imperfect logs. FIGS. 1A and 1B illustrate two typical swept or curved logs 2, 3. FIG. 2 is an end view of log 2 showing how the swept or curved feature is typically in a single plane. To create lumber from log 2, side boards 4, illustrated in FIG. 3, are, in this typical example, cut from log 2 by making cuts along lines 6, 7 on either side of log 2 so that each side board 4 has parallel, cut surfaces 8, 9 and unfinished, uncut edges 10, 11. These cuts are made in a conventional manner. What is left of log 2 is called a center cant illustrated as center cant 12 in FIG. 4.

Center cant 12 has opposite, parallel, cut surfaces 14, 15 which correspond to surfaces 9 of boards 4 made at cutting lines 7. The end 16 of center cant 12 in FIG. 4 has a number of dashed cut lines 18 corresponding to where cant 12 will be rip sawn to create center cant lumber 20. See also FIG. 5. To maximize the board feet of lumber from center cant 12, cut lines basically parallel the edges 22 of center cant 12. While the center cant lumber 20 will originally have the same curved or swept shape as center cant 12, most, if not all, of this curve can be removed during drying operations. Side boards 4 are cut differently than center cant 12 to maximize the amount of side board lumber 24 as suggested in FIG. 6. Using conventional computer-controlled edger optimizing systems, the number, size and position of center cant lumber 20 and side board lumber 24 are determined automatically using appropriate computer programs based upon profile information of the side board 4 or center cant 12 scanned into the computer.

For example, U.S. Pat. No. 4,239,072 discloses a method and apparatus for edge trimming a side board. A number of overhead pressure rolls engage the side board as the side board passes along a chain conveyor. The side board is centered by sets of centering rolls. A number of scanning gates are positioned above the conveyor to provide a computer with appropriate information on the profile of the side board. The edging assembly includes a pair of adjustable cutting heads designed to chip the unwanted edges from the side board. The cutting heads are slewed in a direction perpendicular to the direction of movement of the board by hydraulic cylinders so that one or more pieces of side board lumber can be cut from a single side board.

U.S. Pat. No. 4,449,557, assigned to the same assignee as U.S. Pat. No. 4,239,072, uses substantially the same system for delivering partially cut logs to an edging assembly as the '072 patent. However, instead of using angled edge chippers, as in the '072 patent, the '557 patent uses sawing disks or saw blades to make the edge cuts. The entire edger saw system moves as a unit so that the sawing disks can skew, that is change the angle between the axis of rotation of the sawing disks and the direction of feed of the work piece and can slew, that is move laterally along a line generally perpendicular to the direction of feed of the work piece.

Some conventional edger optimizer systems measure the boards transversely and then position the board onto a feeding mechanism and move the board longitudinally into the edger. This conventional method requires a considerable amount of expensive scanning, positioning and transporting equipment to carry out the process. Conventional systems also commonly create cumulative scanning, positioning and transport errors that make the systems somewhat less than optimal. With regard to the '557 patent, complex board centering mechanisms, multiple scanner heads, complex and high maintenance feeding and tracking devices, and complex high inertia edger rotation devices are all characteristic of the system described in the patent.

U.S. Pat. Nos. 5,761,979 and 5,870,936 describe a saw assembly that includes a rotatable arbor on which two or more saw blades are mounted. The driving interface between the saw blades and the arbor permits the axis of rotation of the saw blades to be collinear with the arbor axis or skewed a few degrees in either direction. A saw blade positioning assembly includes pairs of guide arms which engage the sides of the saw blades to position each saw blade at the proper location along the arbor and at the proper skew angle. The guide arms are moved in unison so that the axial position and the skew angle of each of the saw blades can be changed in unison before and during sawing operations.

In these designs, the use of guide arms that engage the sides of the rotating saw blades, require constant maintenance and can often lead to problems. These saw guide arms require the use of saw blade lubricants and cooling water that reduce the fuel value of the saw dust and cause environmental and waste water concerns.

BRIEF SUMMARY OF THE INVENTION

An example of a wood product assembly includes a frame, a cutter subassembly and a skewing assembly. The cutter subassembly is supported by the frame and comprises a slewing assembly, having a slewing axis, and a cutter positioning body secured to and movable by the slewing assembly for movement along the slewing axis. The cutter subassembly also includes a spindle housing, mounted to the cutter positioning body for pivotal movement about a pivot axis, and a cutter driver. A spindle is mounted to the spindle housing for rotation about a spindle rotation axis, the spindle connected to and rotatable by the cutter driver. The cutter subassembly also includes a cutter affixed to and movable with the spindle. A skewing assembly is supported by the frame and is coupled to the spindle housing. The skewing assembly is operable to position the spindle rotation axis to a selected angular orientation over a range of angular orientations thereby positioning the cutter at a selected skew angle. In some examples the cutter driver comprises a drive source fixedly secured to the frame and an extendable length universal-joint driveline assembly. In some examples of the driveline assembly connects the drive source to the spindle to transmit torque to the spindle while allowing both: [1] the spindle rotation axis to turn at an angle relative to the drive source, and [2] the spindle to move closer to or further away from the drive source.

One example of a method for slewing and skewing a cutter while the cutter cuts a log moving along a feed path is carried out as follows. A cutter is mounted to a housing for rotation about a rotation axis. The housing is pivotally mounted to a cutter positioner for pivotal movement of the housing and cutter therewith about a pivot axis. The cutter is slewed by positioning the housing and cutter therewith along a cutter shift axis, the cutter shift axis being transverse to a feed path of a log. The cutter is skewed by pivoting the housing and cutter therewith about the pivot axis. The cutter is rotated about the rotation axis.

Other features, aspects and advantages of the present invention can be seen on review the figures, the detailed description, and the claims which follow.

LIST OF REFERENCE NUMERALS

Figure 1A:
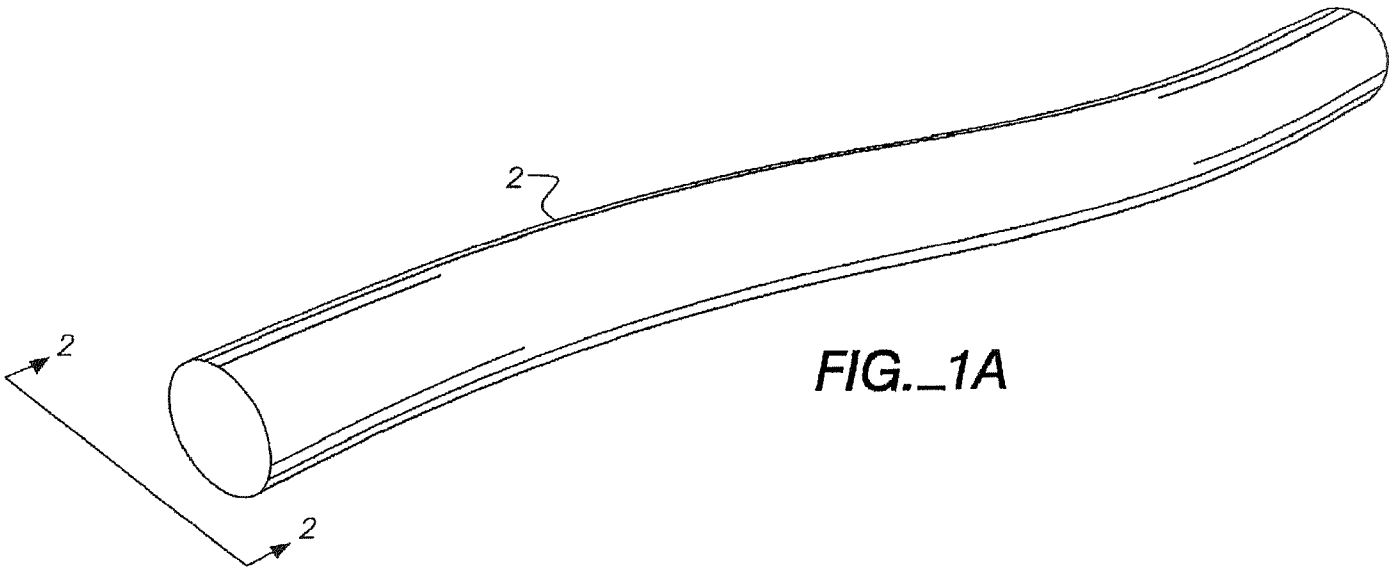
FIGS. 1A and 1B are overall views showing two different types of curved or swept logs.
Figure 1B:
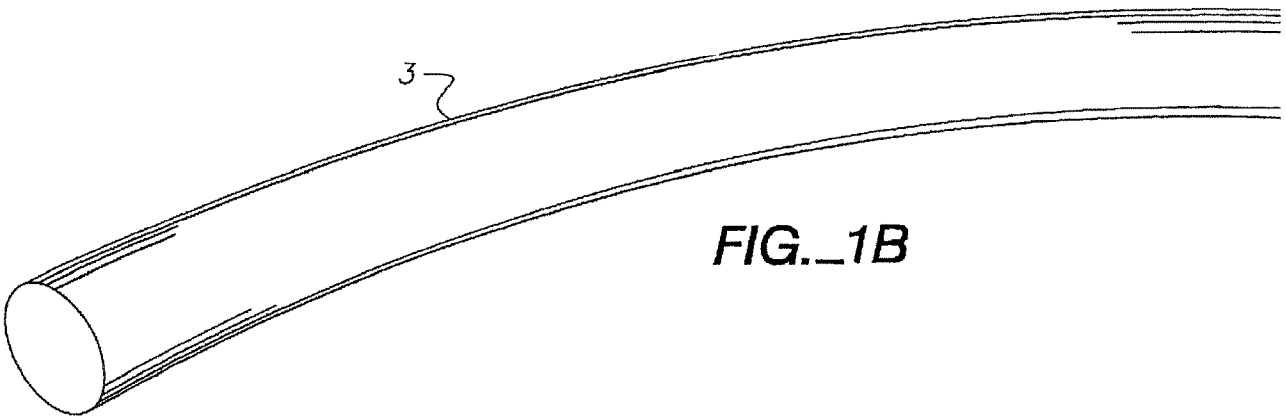
Figure 2:
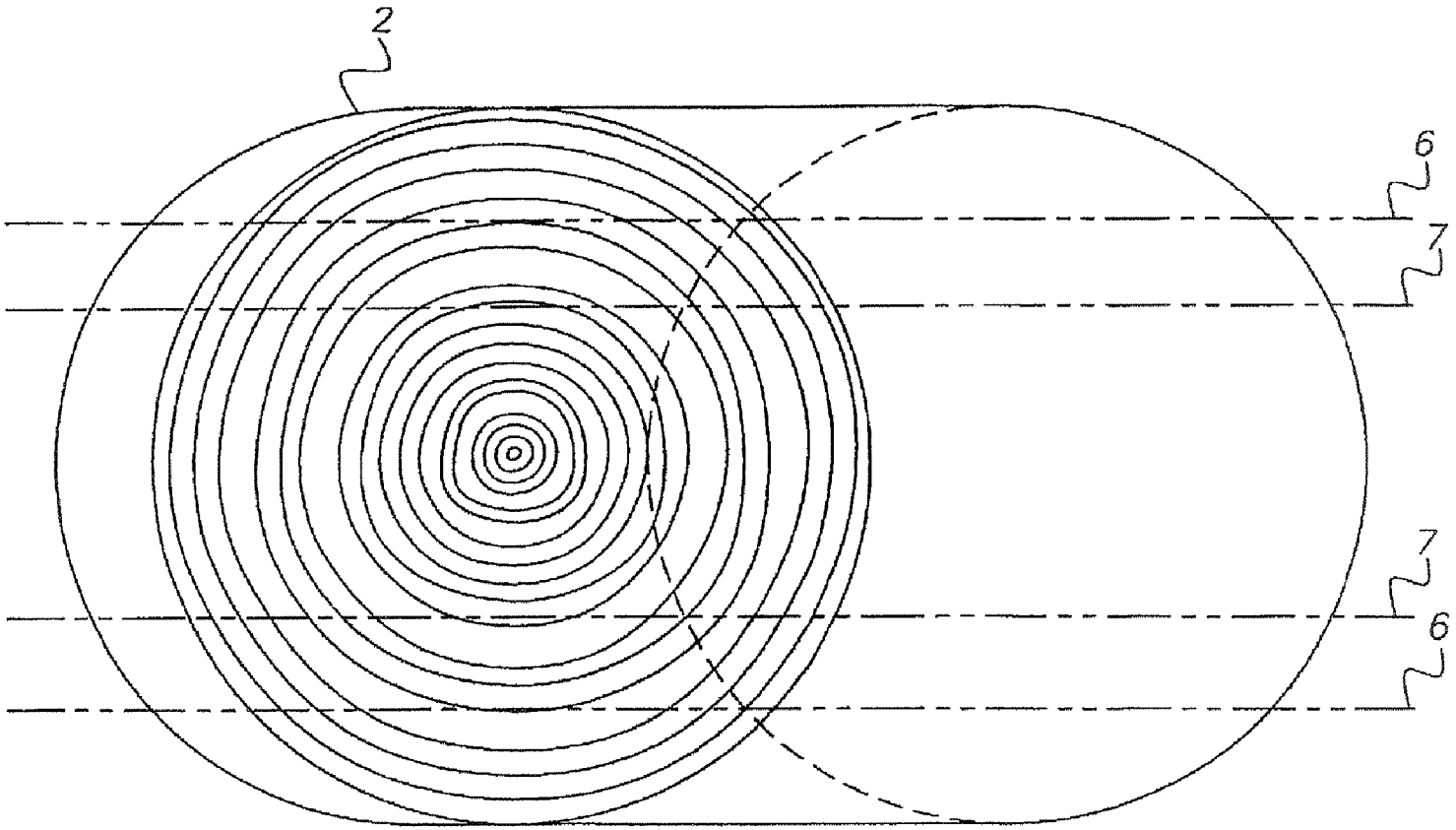
FIG. 2 is an end view of the log of FIG. 1A taken along line 2-2.
Figure 3:
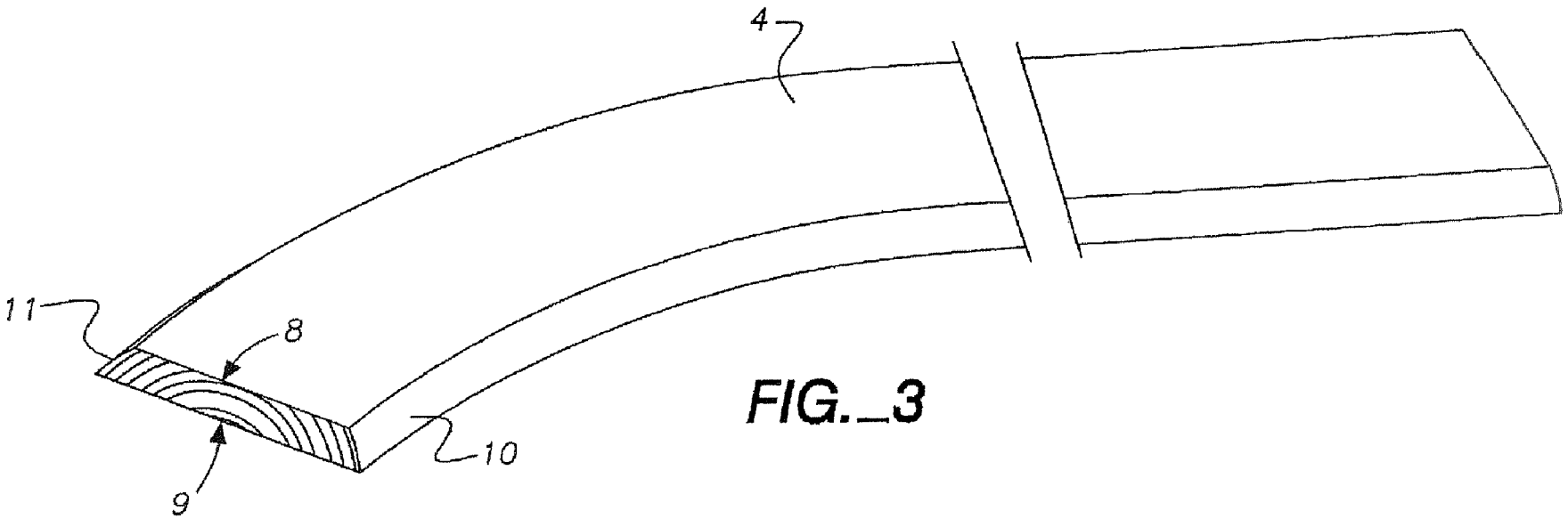
FIG. 3 is an enlarged view showing a side board cut from the log of FIG. 2.
Figure 4:
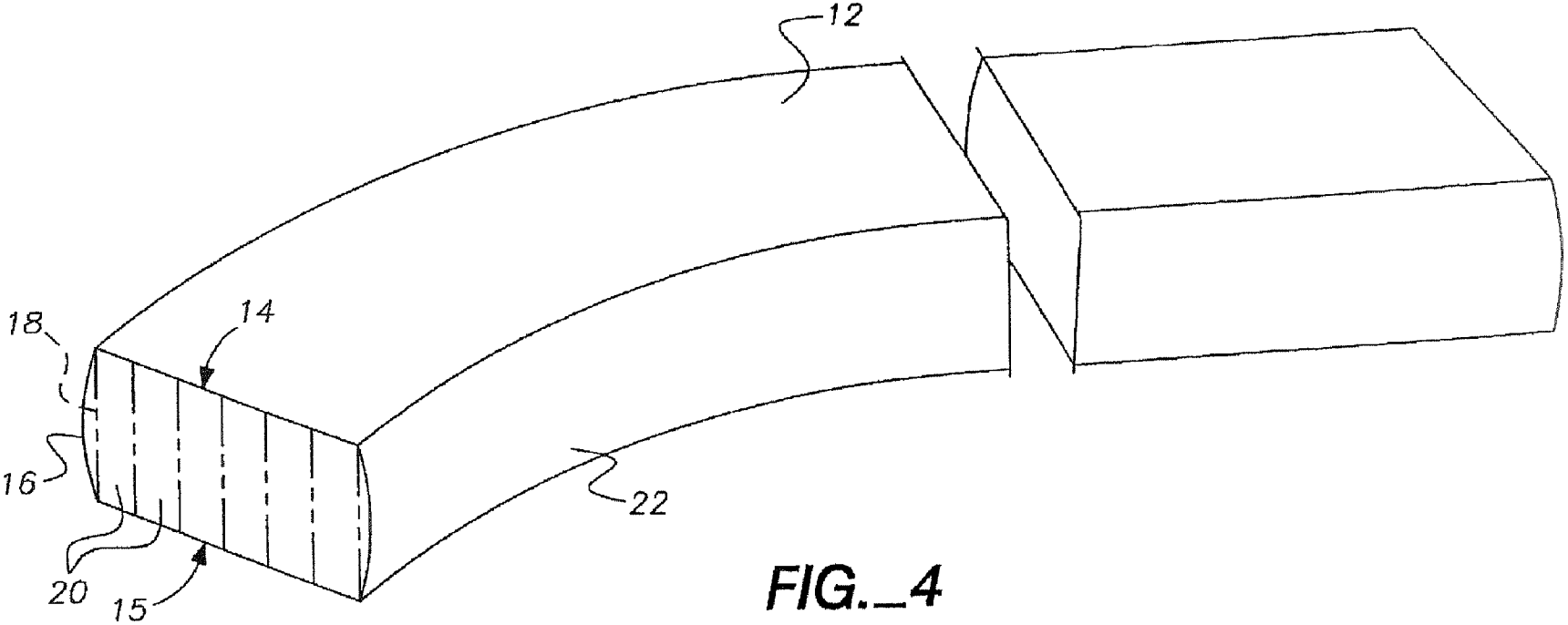
FIG. 4 is an enlarged view showing a center cant cut from the log of FIG. 2.
Figure 5:
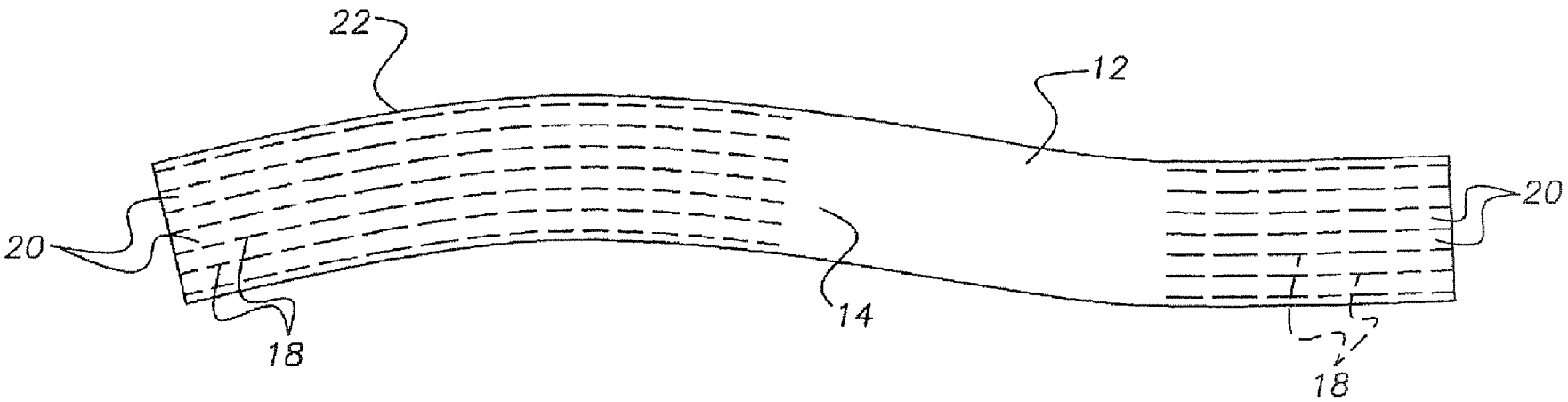
FIG. 5 is a simplified top plan view of the center cant of FIG. 4 illustrating dashed cut lines and the resulting center cant lumber to be cut from the center cant.
Figure 6:
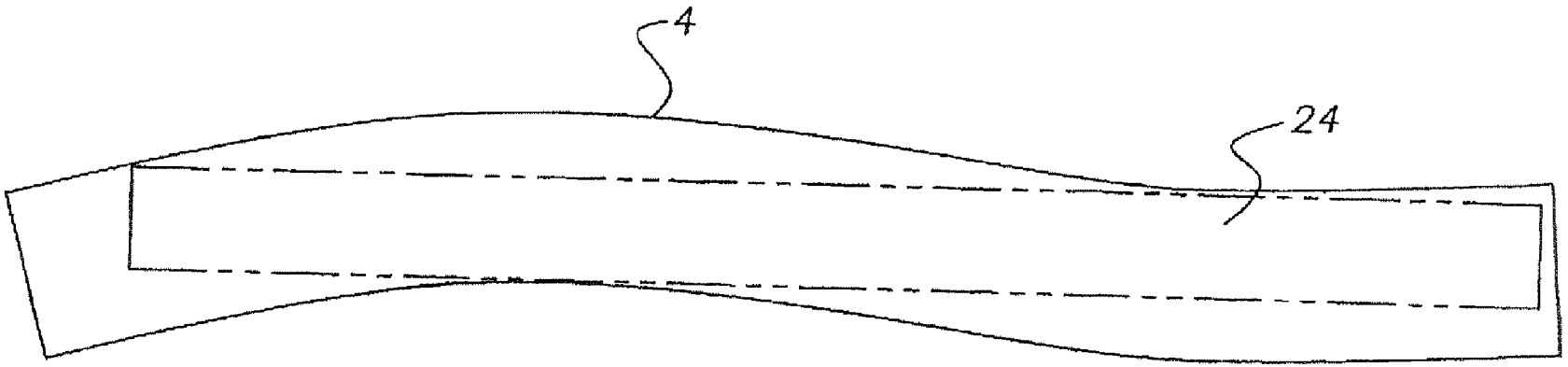
FIG. 6 is a simplified top plan of the side board of FIG. 3 illustrating the outlines of side board lumber to be cut from the side board of FIG. 3.

| | |
|---|---|
| 2 | Curved Log |
| 3 | Curved Log |
| 4 | Side Boards |
| 6 | Cut Lines |
| 7 | Cut Lines |
| 8 | Cut Surfaces |
| 9 | Cut Surfaces |
| 10 | Uncut Edges |
| 11 | Uncut Edges |
| 12 | Center Cant |
| 14 | Opposite, Parallel, Cut Surfaces |
| 15 | Opposite, Parallel, Cut Surfaces |
| 16 | End of Center Cant 12 |
| 18 | Dashed Cut Lines |
| 20 | Center Cant Lumber |
| 22 | Edges of Center Cant 12 |
| 24 | Side Board Lumber |
| 26 | Chipped Face of Cant 12 |
| 30 | Sawing Apparatus |
| 32 | Infeed Assembly |
| 34 | Infeed Lug Chain |
| 36 | Partially Cut Log |
| 38 | Canted Drive Rolls |
| 40 | Fence |
| 41 | Longitudinal or Forward Direction |
| 42 | Lateral or Infeed Direction |
| 44 | Scanning Conveyor |
| 46 | Scanning Assembly |
| 48 | Scanner |
| 50 | Controller |
| 52 | Cutting Assembly |
| 54 | Pressroll Assembly |
| 56 | Saw Assembly |
| 58 | Driven Feed Chain |
| 60 | Pivotal Press Rolls |
| 62 | Drum Reman Head |
| 64 | Driven Exit Rolls |
| 66 | Sawn Lumber |
| 68 | Discharge Assembly |
| 70 | Paddle Picker Outfeed |
| 72 | Saw Blade Positioner Assembly |
| 74 | Saw Spindle |
| 75 | Saw Blades |
| 76 | Saw Positioner |
| 78 | Skewing Assembly |
| 80 | Saw Blade Slewing Assembly |
| 82 | Saw Positioner Body |
| 84 | Pivoting Spindle Housing |
| 86 | Spindle Bearings |
| 87 | Clamping Collar |
| 88 | Annular Side Surface of Saw Blade 75 |
| 90 | Saw Shift Axis |
| 92 | Vertical Pivot Axis of 84 |
| 93 | Pivot Axis of 142 |
| 94 | Skewing Angle |
| 95 | Pivot Axis of 142 |
| 96 | Pivot Bearings |
| 99 | Spindle Rotation Axis |
| 101 | Rotation Axis of Fixed Drive Source 131 |
| 104 | Chip Head |
| 114 | Skewing Positioner |
| 116 | Skewing Drive Shaft |
| 118 | Bell Crank Arm |
| 119 | Bell Crank Bushing |
| 120 | Sliding Rotary Bell Crank Assembly |
| 121 | Thrust Washers |
| 122 | End of Skewing Drive Shaft 116 |
| 123 | Locking Nuts |
| 124 | End of Skewing Drive Shaft 116 |
| 126 | Linear Bearings |
| 128 | Saw Assembly Frame |
| 129 | One End of Skewing Cylinder 114 |

-continued

| LIST OF REFERENCE NUMERALS | |
|---|---|
| 130 | Steering Arm |
| 131 | Fixed Drive Source |
| 132 | Skewing Linkage |
| 133 | Ball Joint |
| 136 | Linear Positioner |
| 140 | Extendable Universal Joint Driveline Assembly |
| 141 | Feed Path |
| 142 | Universal Joint |
| 143 | Universal Joint |
| 144 | Slip Joint |
| 150 | Packing Nut |
| 151 | Lock Nut |
| 152 | Internal Splined Drive Flange |
| 153 | Drive Flange Adaptor |
| 154 | Hollow Shaft of Fixed Drive Source 131 |
| 155 | Smooth Bore of Hollow Shaft 154 |
| 156 | Guide Piston |
| 157 | Lubrication Port and Fan Mounting Adaptor |
| 160 | End Yoke of Slip Joint 144 |
| 166 | Shift Shaft |

DETAILED DESCRIPTION OF THE INVENTION

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Like elements in various embodiments are commonly referred to with like reference numerals.

The present invention is directed to a wood product assembly, such as an improved edge trimming and board ripping apparatus, and method which provides a greatly simplified approach to, for example, optimally edging and ripping boards.

The edge trimming and board ripping apparatus includes an improved saw assembly used as a part of a sawing apparatus. The sawing apparatus, in one example, includes an in-feed assembly which delivers side boards or center cants one at a time to a scanning assembly. The side boards and center cants both have two parallel cut surfaces and are referred to generically as partially cut logs, cut logs or just logs. The scanning assembly preferably includes a scanner adjacent to a scanning conveyor. The scanner scans the cut log and provides a profile of the log to a computer which controls the operation of the improved saw assembly. The saw assembly is preferably part of a cutting assembly. The cutting assembly includes a press roll assembly which maintains the cut log in the same orientation, passing through the saw assembly, as the cut log had when it passed the scanner.

Figure 7:
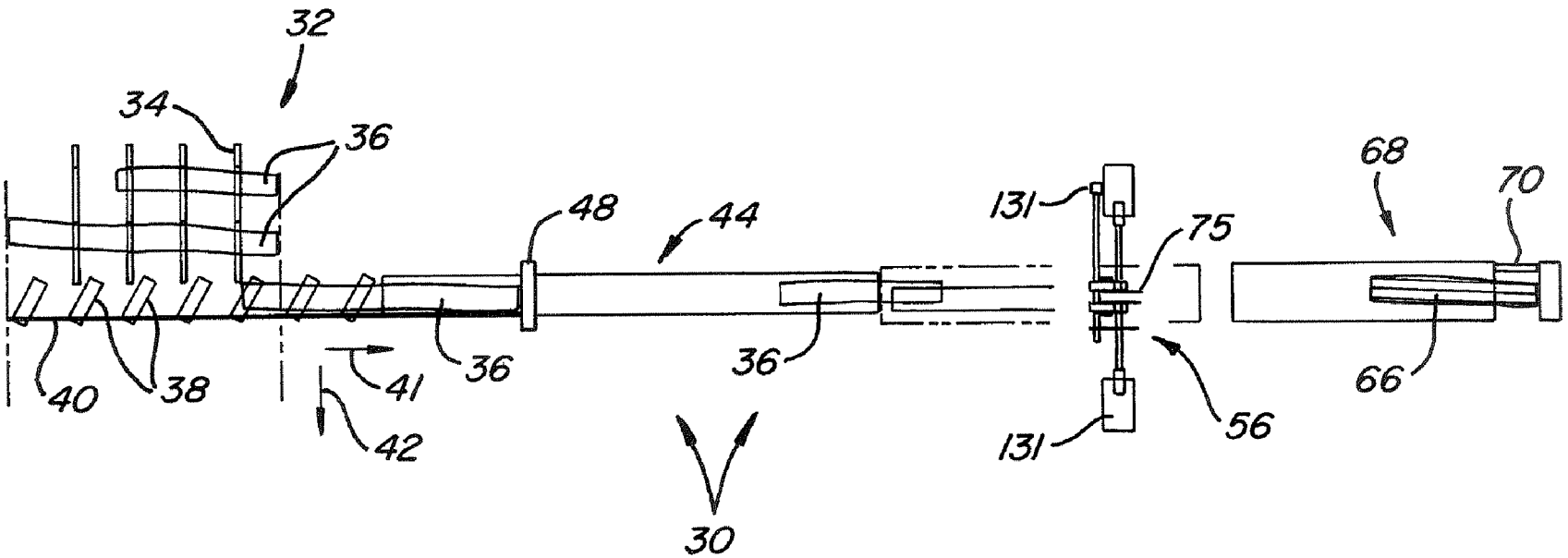
FIG. 7 is a simplified top plan view of an example of a sawing apparatus made according to the invention.
Figure 8:
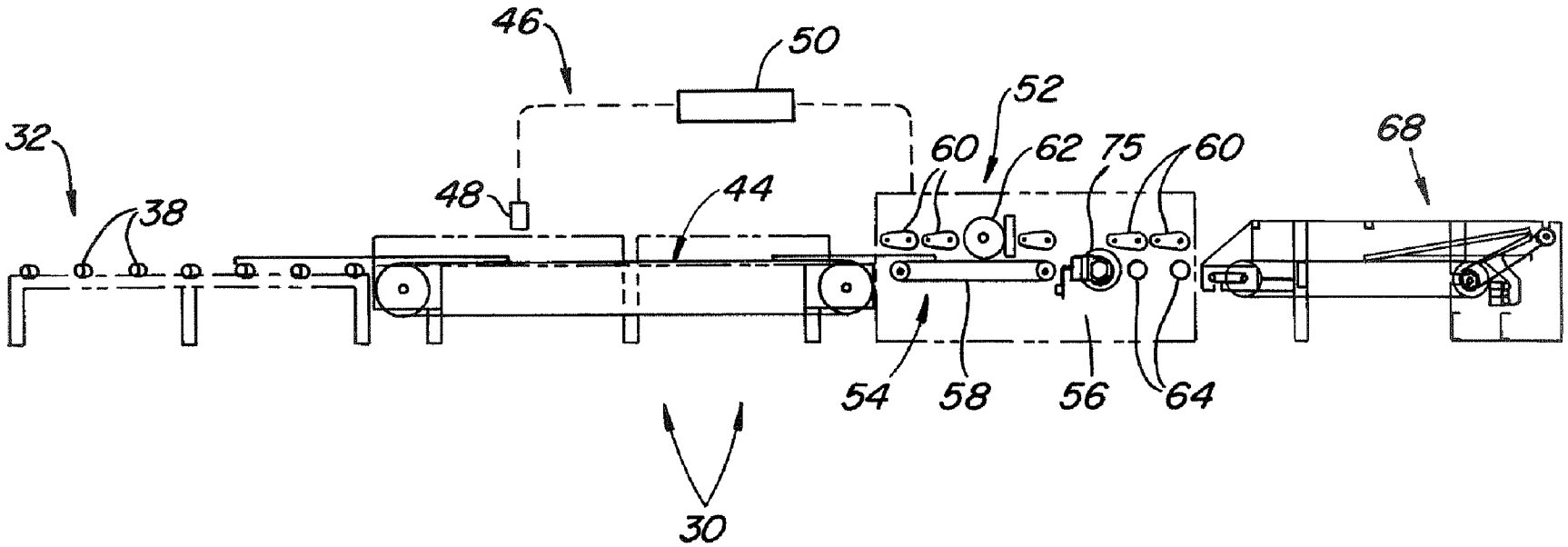
FIG. 8 is a simplified side view of the apparatus of FIG. 7.
Figure 9:
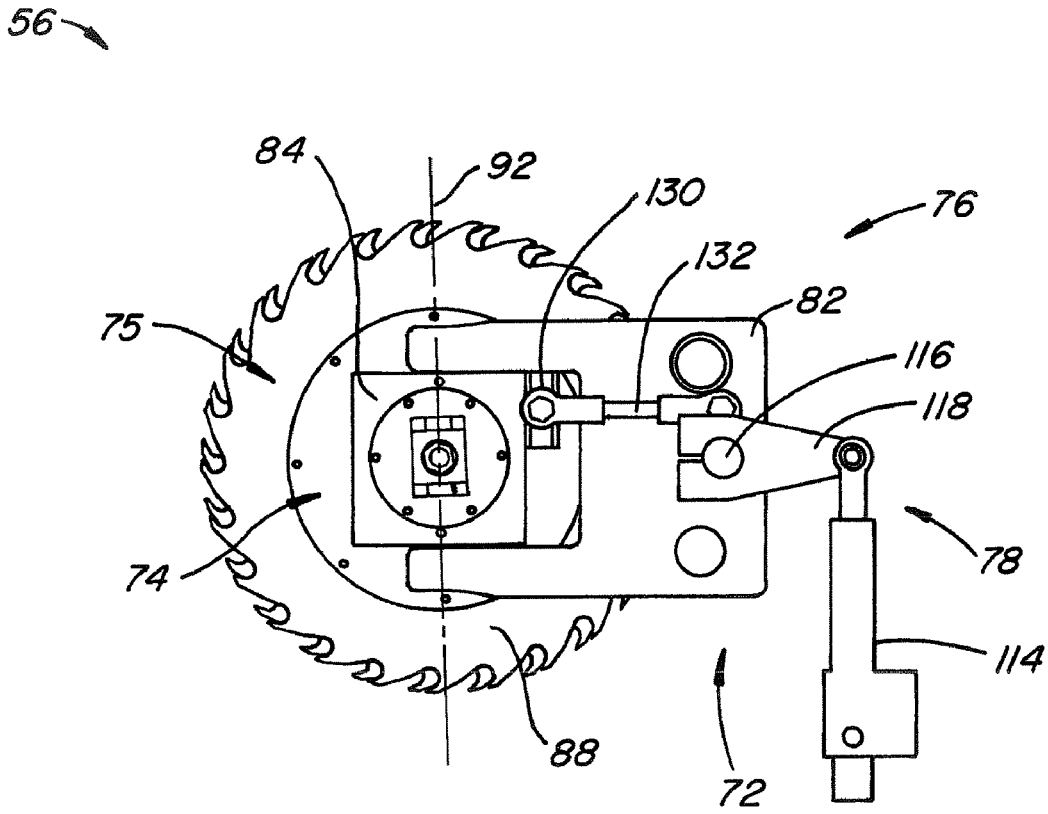
FIG. 9 is an enlarged side view of the saw assembly of FIG. 8.
Figure 10:
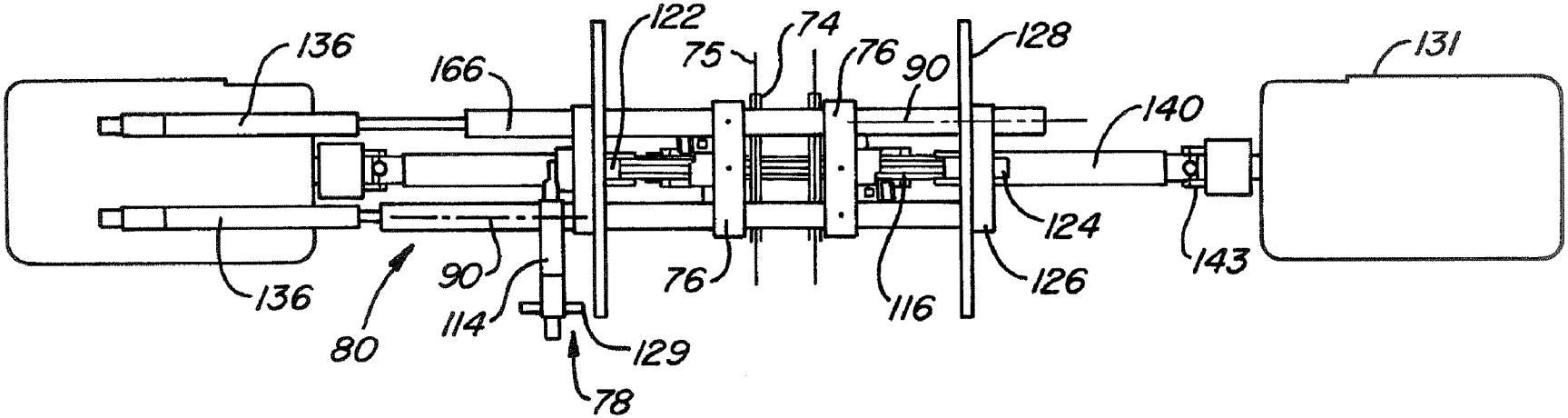
FIGS. 10 and 11 are end and top views of the saw assembly of FIG. 9 showing a set of two saw blade positioner assemblies and associated saw blades at a first set of locations and at a zero cant in FIG. 10 and at a 2° cant in FIG. 11.
Figure 11:
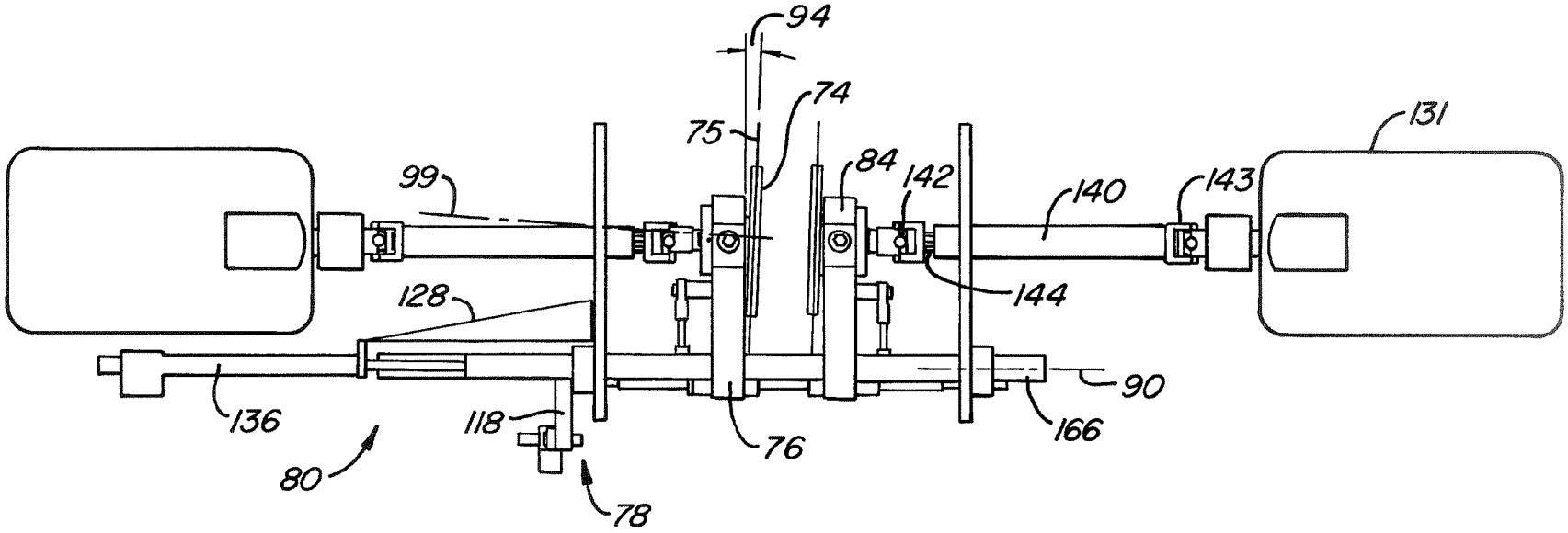
Figure 12:
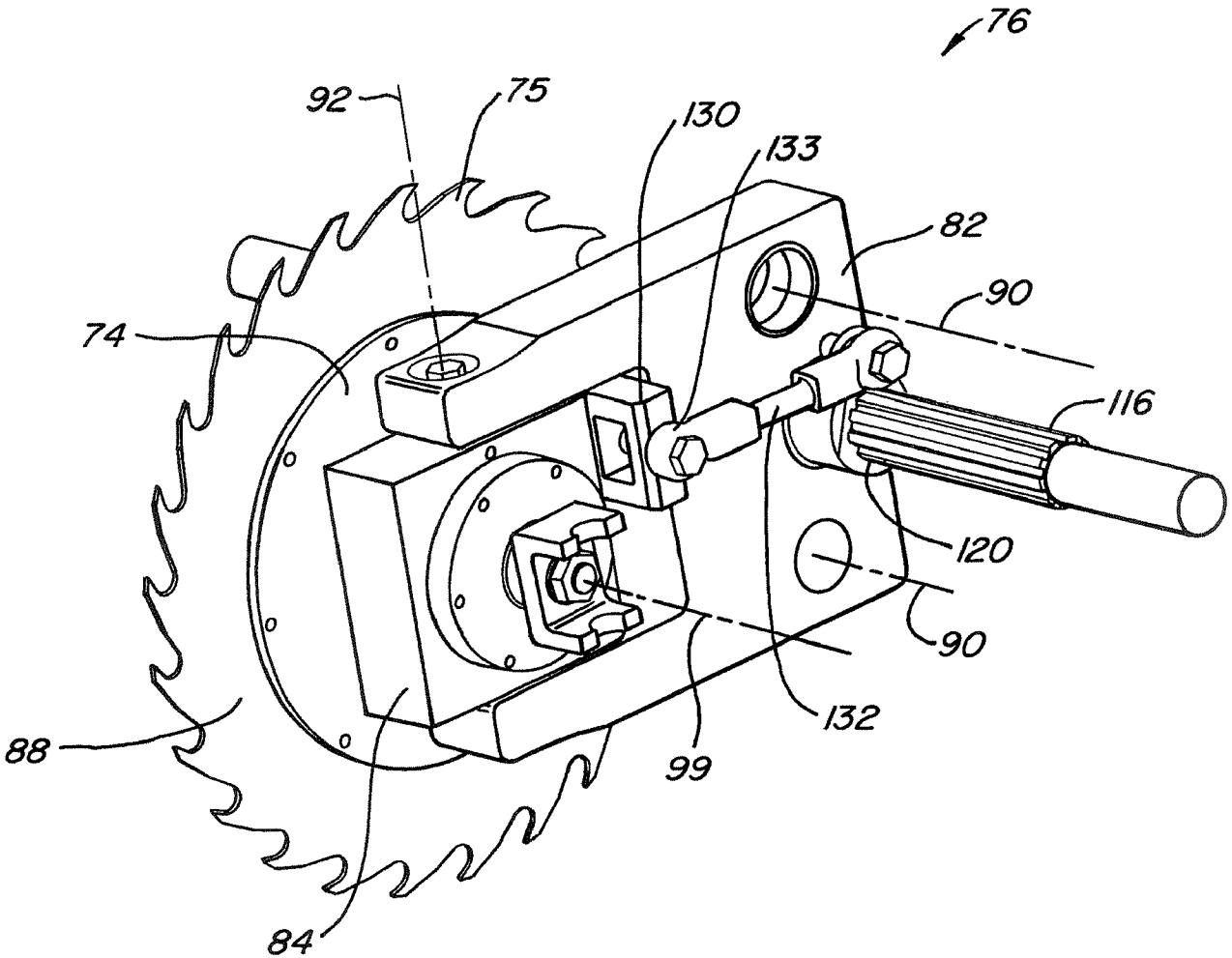
FIG. 12 is an enlarged isometric view of the saw blade positioner assembly of FIG. 9 together with a saw blade.
Figure 14:
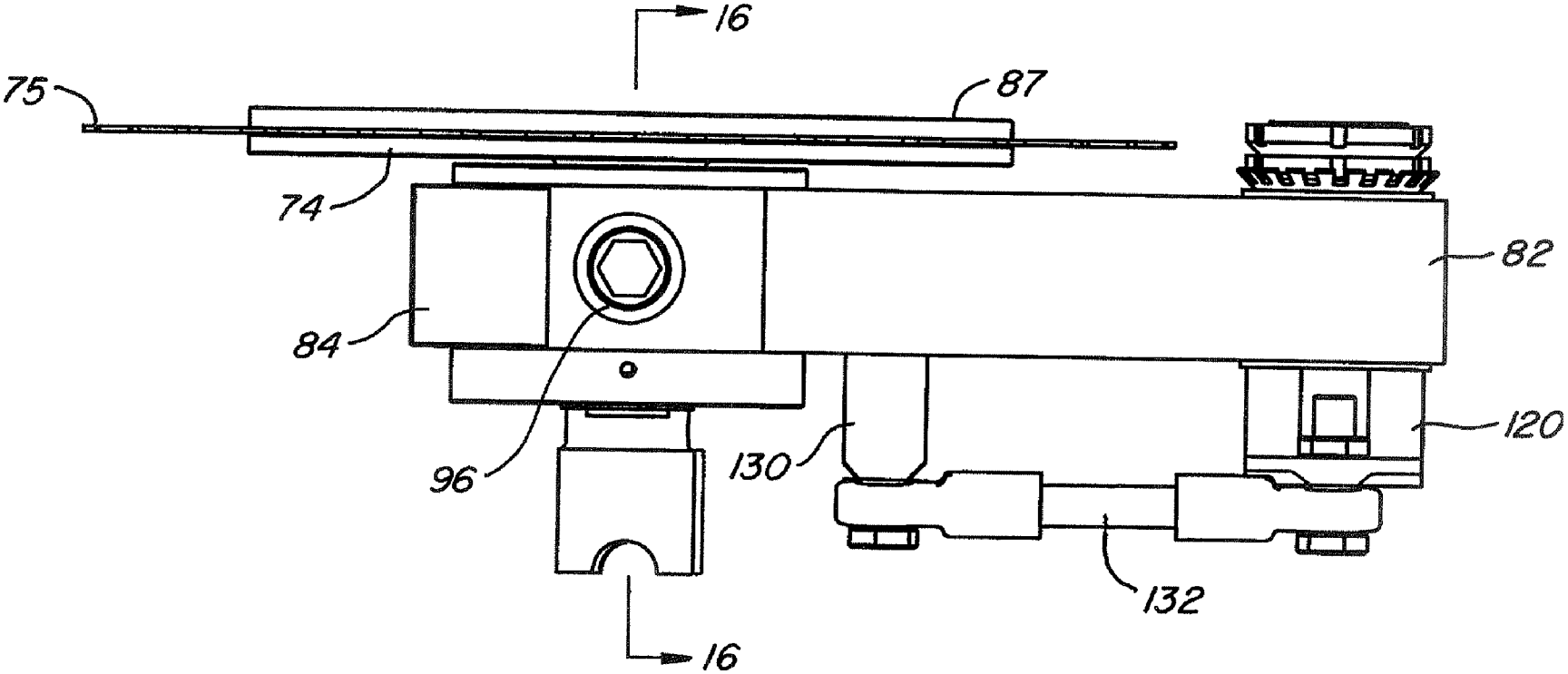
Figure 15:
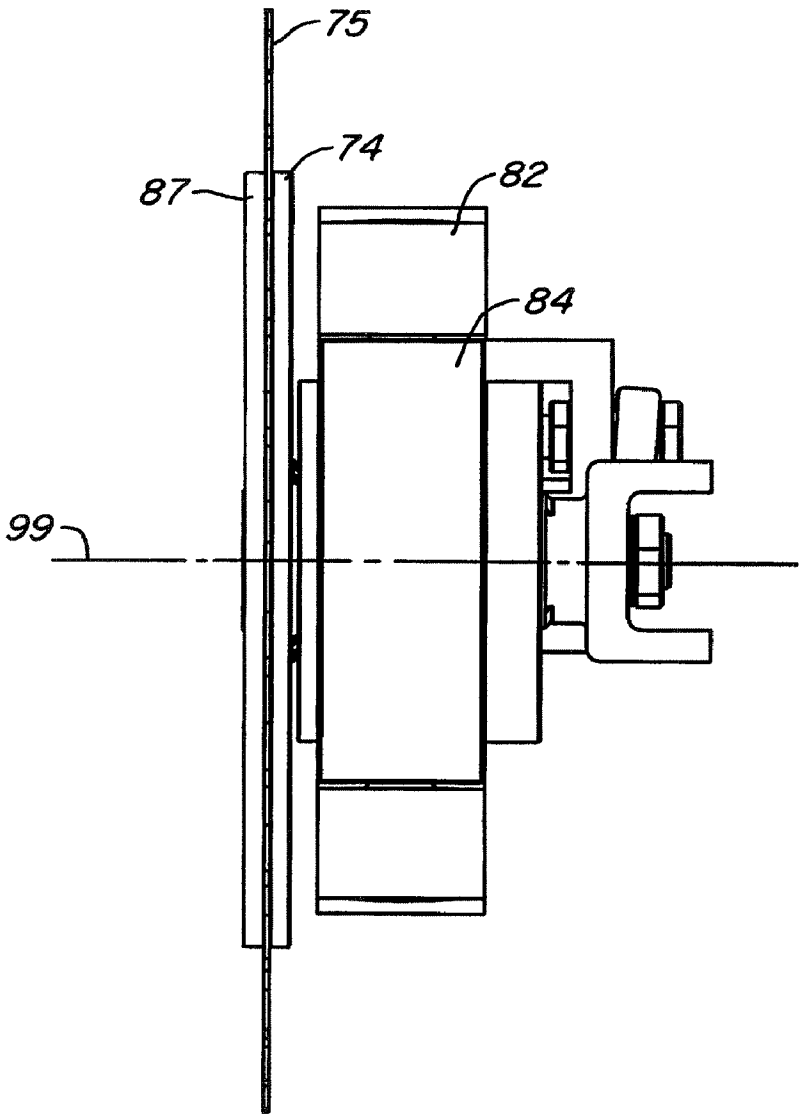
Figure 16:
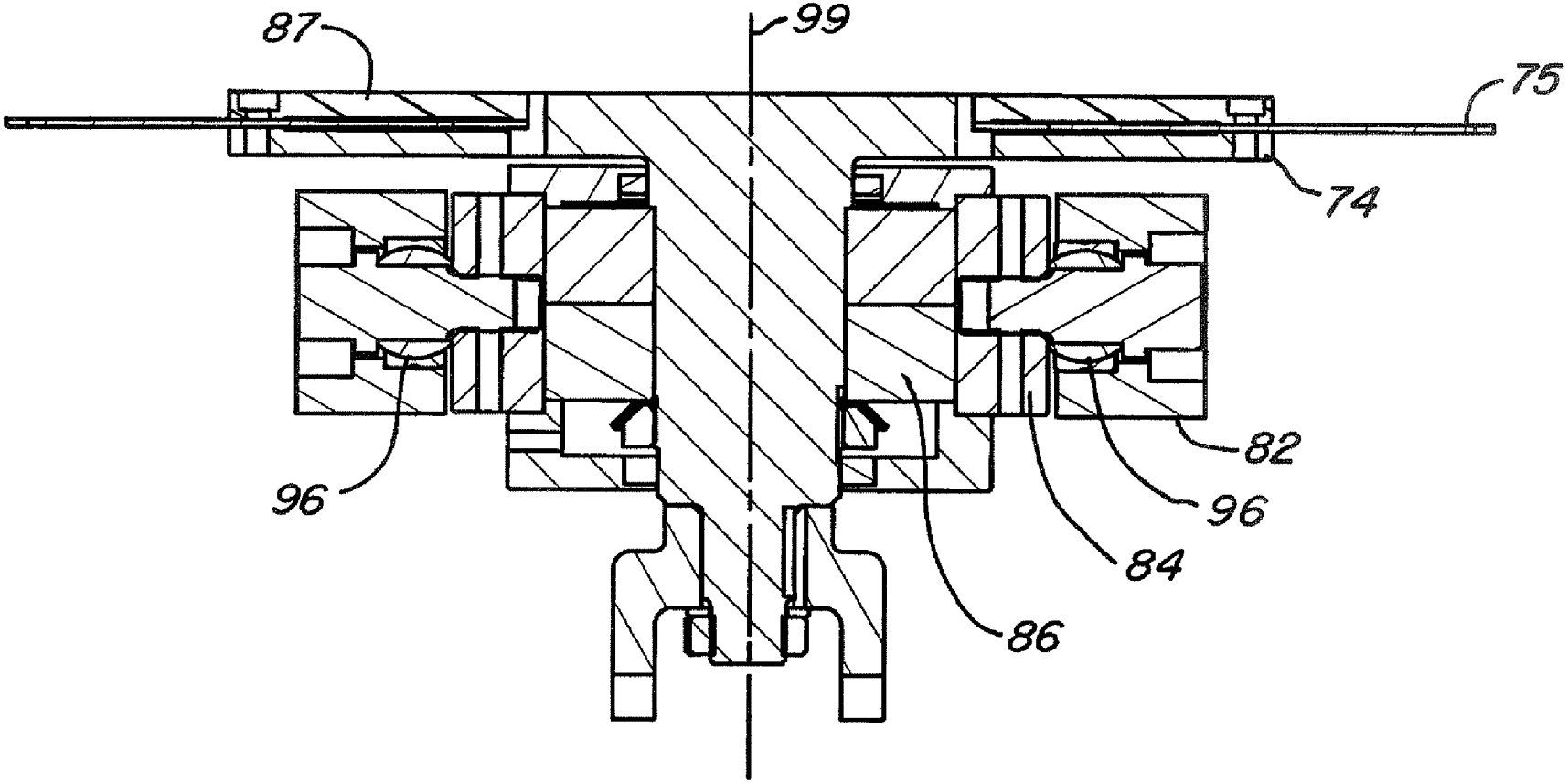
FIG. 16 is a somewhat simplified cross-sectional view taken along line 16-16 in FIG. 14.
Figure 17:
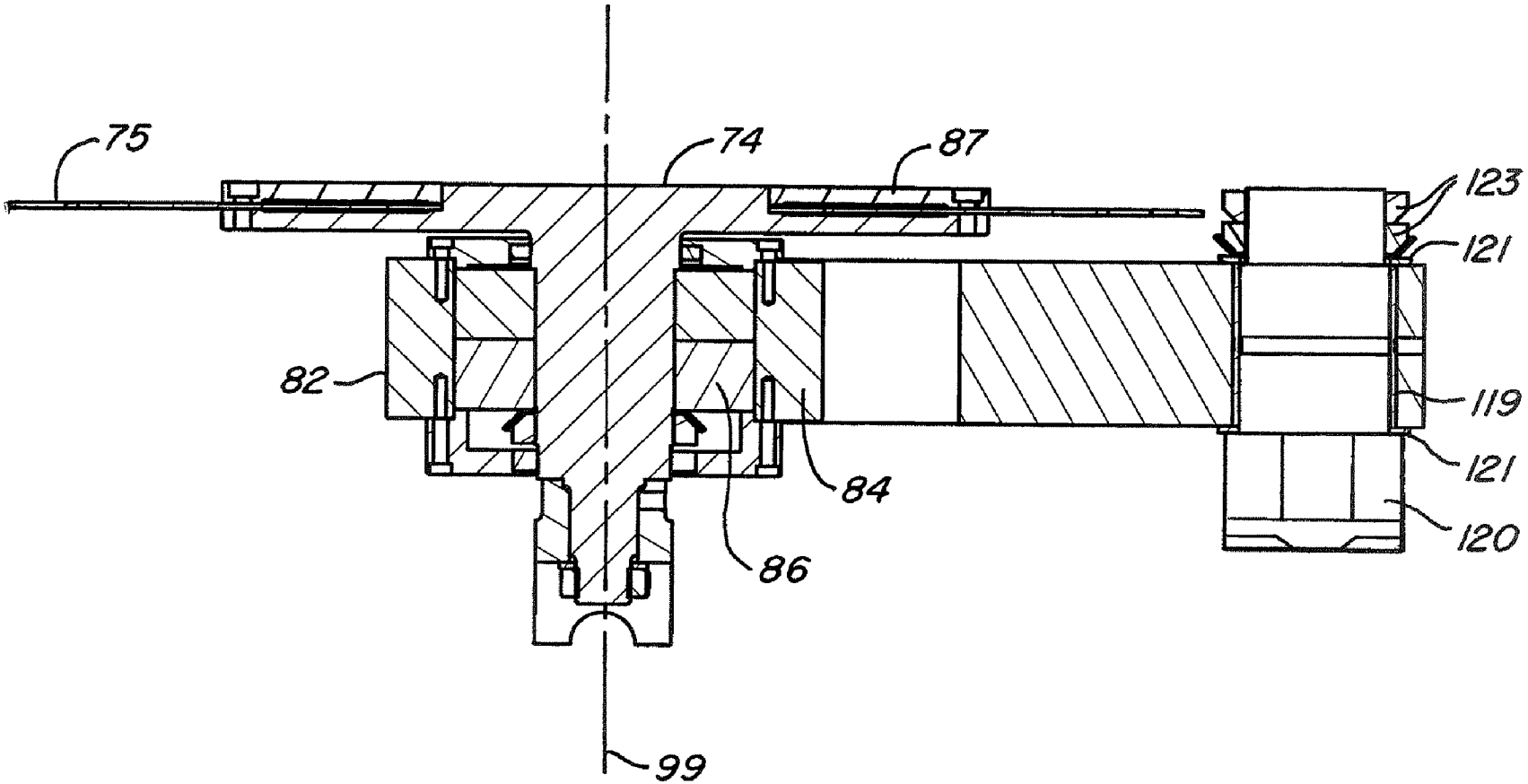
FIG. 17 is an enlarged cross-sectional view taken along line 17-17 in FIG. 13.
Figure 18:
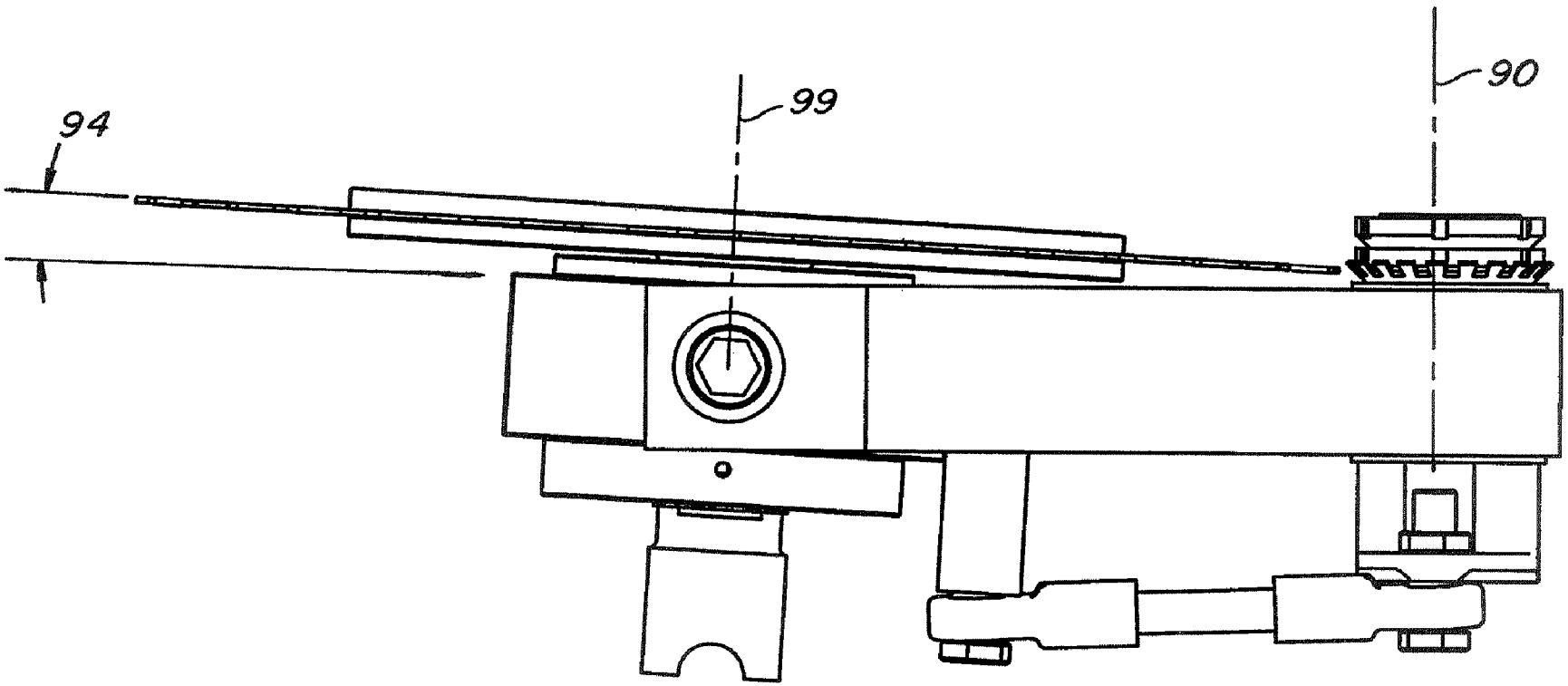
FIG. 18 is a top view of saw blade positioner of FIG. 12 showing the saw blade at a 2 degree angle.
Figure 19:
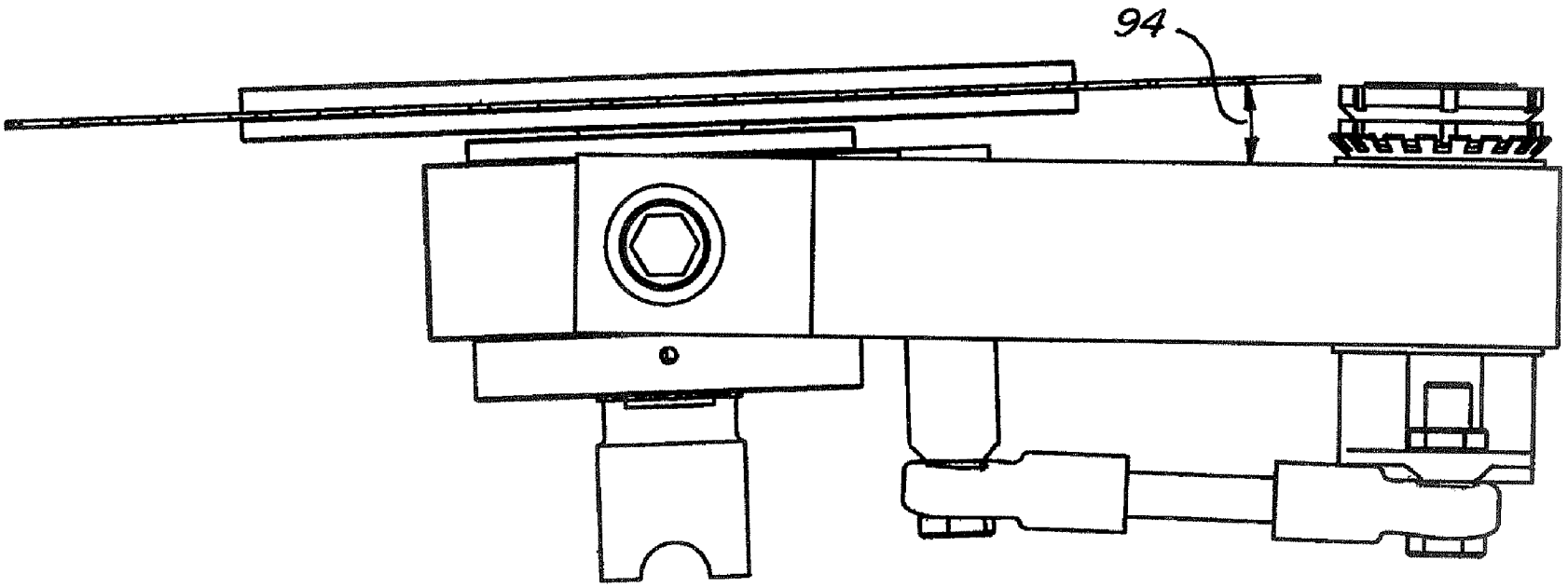
FIG. 19 is a top view of saw blade positioner of FIG. 12 showing the saw blade at a −2 degree angle.

A saw assembly 56, see FIGS. 7, 8 and 9, includes two or more saw blades 75 as shown in FIGS. 10 and 11. Each saw blade is individually supported, positioned and driven by subcomponents of saw assembly 56 as follows. Each saw blade is rigidly attached to a saw spindle 74. Each saw spindle 74 and saw blade 75, connected and rotating together, are mounted in a pivoting spindle housing 84. The pivoting spindle housing contains spindle bearings 86 (see FIG. 16) that allow free rotational movement of the saw spindle 74. Each pivoting spindle housing 84 is pivotally mounted to a saw positioner body 82 of a saw positioner 76. See FIG. 12. Each saw positioner body 82 supports a pivoting spindle housing 84 while allowing the spindle housing to turn at a slight angle about a vertical pivot axis 92 to facilitate saw skewing (typically approximately +/−2 degrees) through the use of two pivot bearings 96 as shown in FIGS. 14 and 16. The saw positioner 76 also shifts (repositions) positioner body 82 in a linear motion at a right angle (or transversely) to the log's direction of travel to provide the required slewing movement of the saw blade/saw spindle assembly during saw operation.

Each saw spindle is coupled to and driven by an extendable universal-joint driveline assembly 140. The other end, opposite the saw spindle end, of each extendable universal-joint driveline assembly is coupled to a fixed drive source 131, meaning one with only rotational movement. Examples of a fixed drive source could include a fixed motor 131 or a fixed drive shaft coupled to a remote drive motor 131. The axis of rotation of the fixed drive source would preferably be at a right angle to the log's direction of travel and generally parallel to the saw shift axis 90 (see FIGS. 10, 11 and 12).

The extendable universal joint driveline assembly transmits torque to the saw spindle while allowing both: [b 1] the axis of rotation of the saw spindle to turn at an angle relative to the axis of rotation of the fixed drive source, [2] and the saw spindle to move closer to or further away from the fixed drive source. The extendable universal joint driveline 140 would typically have two universal joints 142, 143 and a slip joint 144. The extendable driveline would typically be of a two-part splined or keyed shaft construction that permits high torque transmission while allowing driveline extensions and retractions as required during saw operation.

FIGS. 10 and 11 show the preferred embodiment of a saw assembly when composed of 2 saw blades. In this example two shift shafts 166 support and position each saw positioner 76. Each saw positioner 76 is rigidly connected to one of its shift shafts 166 and slides on the other. The two shift shafts that support the saw positioners are supported on each end by the saw assembly frame 128. Linear positioners 136, located outside and connected to the saw assembly frame 128, are coupled to each shift shaft 166 and actuate each shift shaft to provide the required saw positioning and slewing motion for each saw blade along the saw shift axis 90 during saw operation. Linear bearings 126 are used where the shift shafts intersect the saw assembly frame 128 to provide the proper guiding and support.

Figure 13:
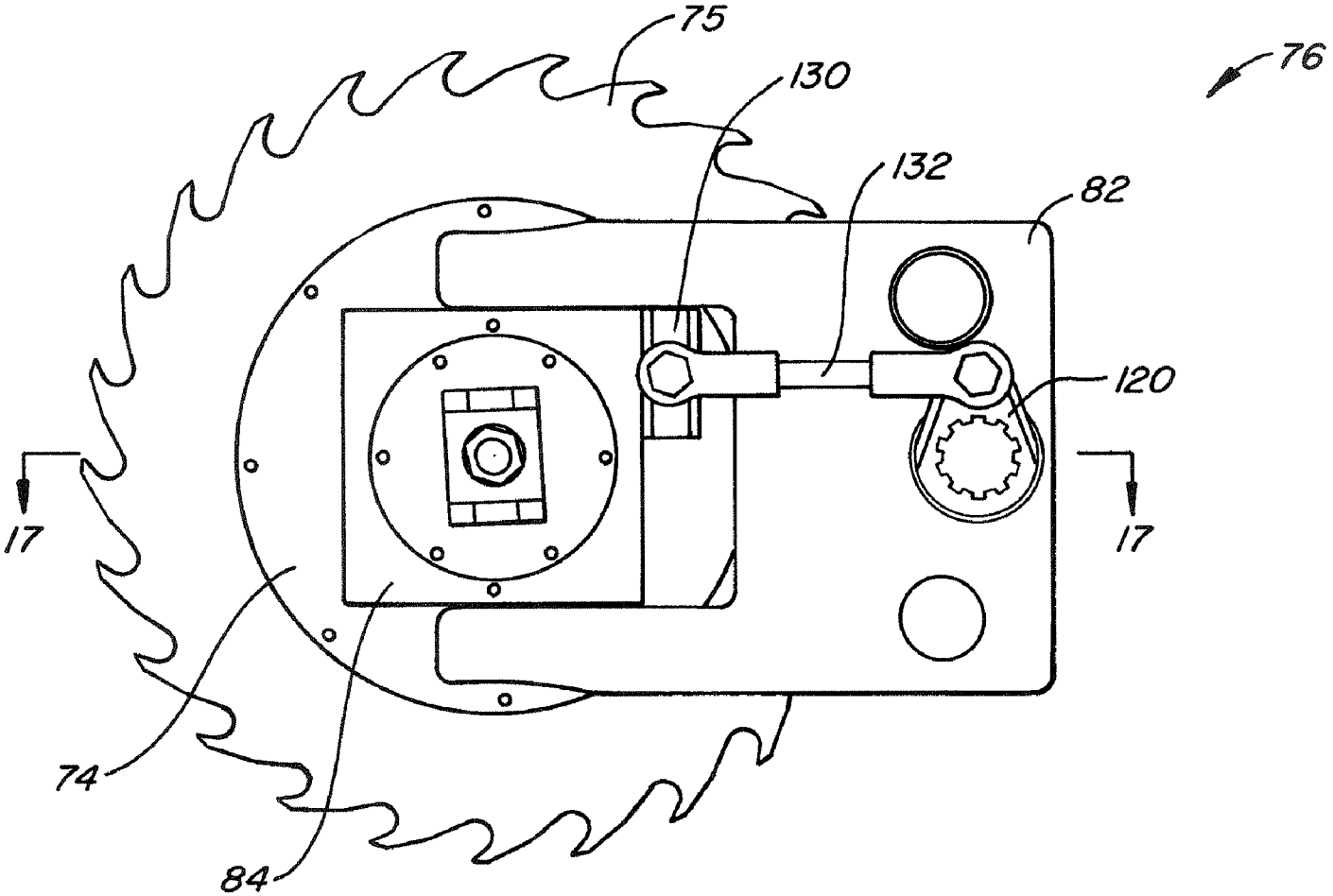
FIGS. 13, 14 and 15 are side, top and end views of the saw blade positioner of FIG. 12.

In this embodiment, a skewing drive shaft 116 is used to skew the saw blade/saw spindle assembly 74, 75 during saw operation. Skewing drive shaft 116 extends parallel to saw shift axes 90. A single skewing positioner 114 actuates the rotation of the skewing drive shaft. The skewing drive shaft is linked to the pivoting saw spindle housing 84 through a sliding rotary bell crank assembly 120 and skewing linkage 132 (FIG. 13). The sliding rotary bell crank assemblies 120 move along the skewing drive shaft 116 since they are captivated by the saw positioner bodies 82 (following the slewing motion of the saw positioner 76 specific to each saw blade) and also rotate with the skewing drive shaft 116 (through a splined or keyed connection). The sliding rotary bell crank 120 is connected by the skewing linkage 132 to the steering arm 130 by a ball joint 133. Steering arm 130 is rigidly connected to the pivoting spindle housing 84. Therefore, rotation of skewing drive shaft 116 by skewing cylinder 114 rotates bell crank assembly 120 which drives tie rod linkage 132 causing steering arm 130 and spindle housing 84 therewith to pivot about axis 92 to provide the required saw blade skewing or angular motion.

With the present invention, side board lumber can be cut from side boards by edge trimming the side board and, optionally, rip sawing the side board to create one or more pieces of side board lumber. Also, center cants can be simultaneously edge trimmed and rip sawed to create center cant lumber from the center cant using the saw assembly made according to the invention.

One of the primary advantages of the invention is its simplicity. The partially cut board need not be centered on the scanning conveyor or the feed chain of the press roll assembly but rather simply placed somewhere on the scanning conveyor. Therefore, no centering rolls, as are used with conventional edger systems, are needed. Also, the present invention is designed to be used with only a single scanner, as opposed to the multiple scanners used with conventional systems, thus reducing cost. In addition, the present invention is adapted for use for both edge trimming and board ripping of both side boards and center cants making it very flexible.

An additional advantage is that the saw blade slewing assembly 80 is used to both initially position the saw blades at the desired locations as well as slew, in unison, the saw blades while sawing the log. Also, the same structure used to position the saw blades is used to keep the saw blades at the proper skewing angle. Thus, of the actual sawing components (motor, arbor, saw blades, support frame), the only components which must move during sawing operations are the saw blade spindle assemblies 74, 87; the electric motor which drives the saw spindle remains stationary as well as the support frame which supports the motor and spindle assemblies. The complicated slewing and skewing schemes used with conventional edger systems are eliminated.

Another advantage of the invention is that the saw blades require no guide arms to provide the positioning and stabilization. The use of saw guide arms adds complexity to the sawing system along with requiring constant maintenance. The guide arms require a complex lubricating and cooling system to properly guide, position and stabilize the saw blades. The use of this saw blade lubricating and cooling system increases operating cost and causes the saw dust to be wet reducing its value as a fuel. Excess saw blade cooling water can find its way into storm drains, streams and rivers and cause environmental damage and well as contaminate ground water.

FIGS. 21, 22, 23 and 24 illustrate an alternative saw drive assembly in which the vertical pivot axis 92 of spindle housing 84 passes through the rotational center of universal joint 142. By this positioning, the vertical pivot axis 92 intersects the two pivot axes 93, 95 of universal joint 142 and periodically becomes collinear with pivot axes 93, 95 during each revolution of universal joint 142. This alignment of spindle housing 84 and universal joint 142 permits the saw spindle 74 to rotate about pivot axis 92 and not change the angle between the slip joint 144 and the rotation axis 101 of the fixed drive source 131 thus keeping the slip joint axis collinear with axis 101 of fixed driver 131. This eliminates the need for the second universal joint 143 in the spindle drive system which enhances stability, reduces vibration and reduces the overall width of the sawing apparatus 30.

Saw positioner 76 is coupled with slip joint 144 through universal joint 142 and end yoke 160 of slip joint 144. Fixed driver 131 has a hollow drive shaft 154 fixed in position relative to fixed driver 131. Actuation of fixed driver 131 causes shaft 154 to be rotated about drive axis 101. Slip joint 144 has a splined or keyed external drive surface that engages the internal splined or keyed surface of drive flange 152. Drive flange 152 is rigidly attached and rotates with hollow drive shaft 154 through drive flange adaptor 153. Packing nut 150 and lock nut 151 are mounted on the end of drive flange 152 holding packing material 158 in place preventing contamination from entering the inside of drive flange 152. Rotation of saw spindle 74 is provided by drive device 131 turning hollow drive shaft 154 and drive flange 152 engaging slip joint 144 driving universal joint 142 through end yoke 160. Slip joint 144 has guide piston 156 attached to is end. Guide piston 156 slides with a close tolerance on the smooth bore 155 of hollow drive shaft 154 providing support for the end of slip joint 144. Saw positioner 76 moves along saw shift axis 90 causing slip joint 144 to move along axis 101 of the fixed drive device 131 while the drive device constantly provides rotation to saw spindle 74 through engagement with drive flange 152.

Figure 26:
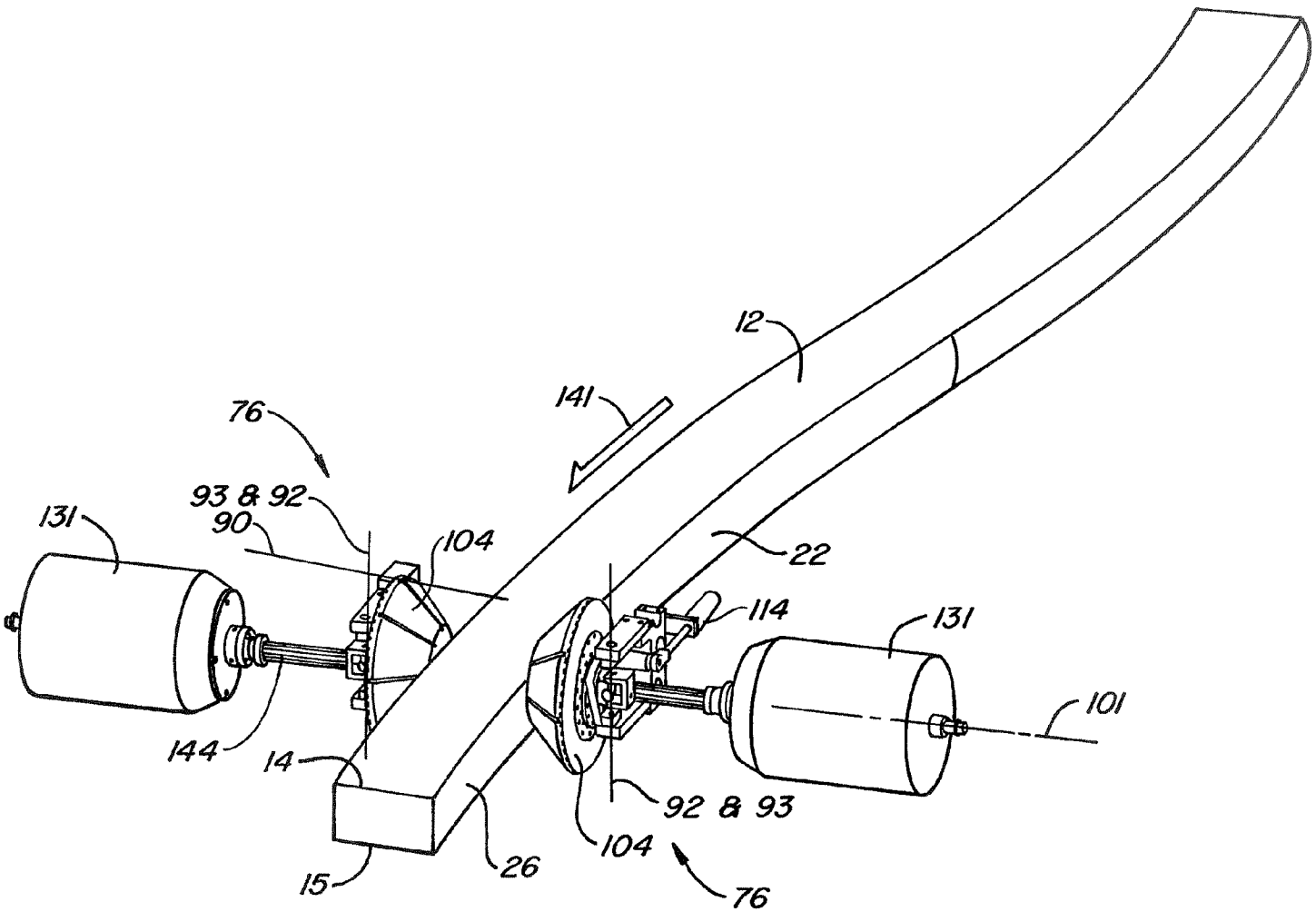
FIG. 26 is an isometric view of two of the saw assemblies of FIG. 21 with the saws replaced with chip heads shown removing the opposing sides of a center cant.
Figure 27:
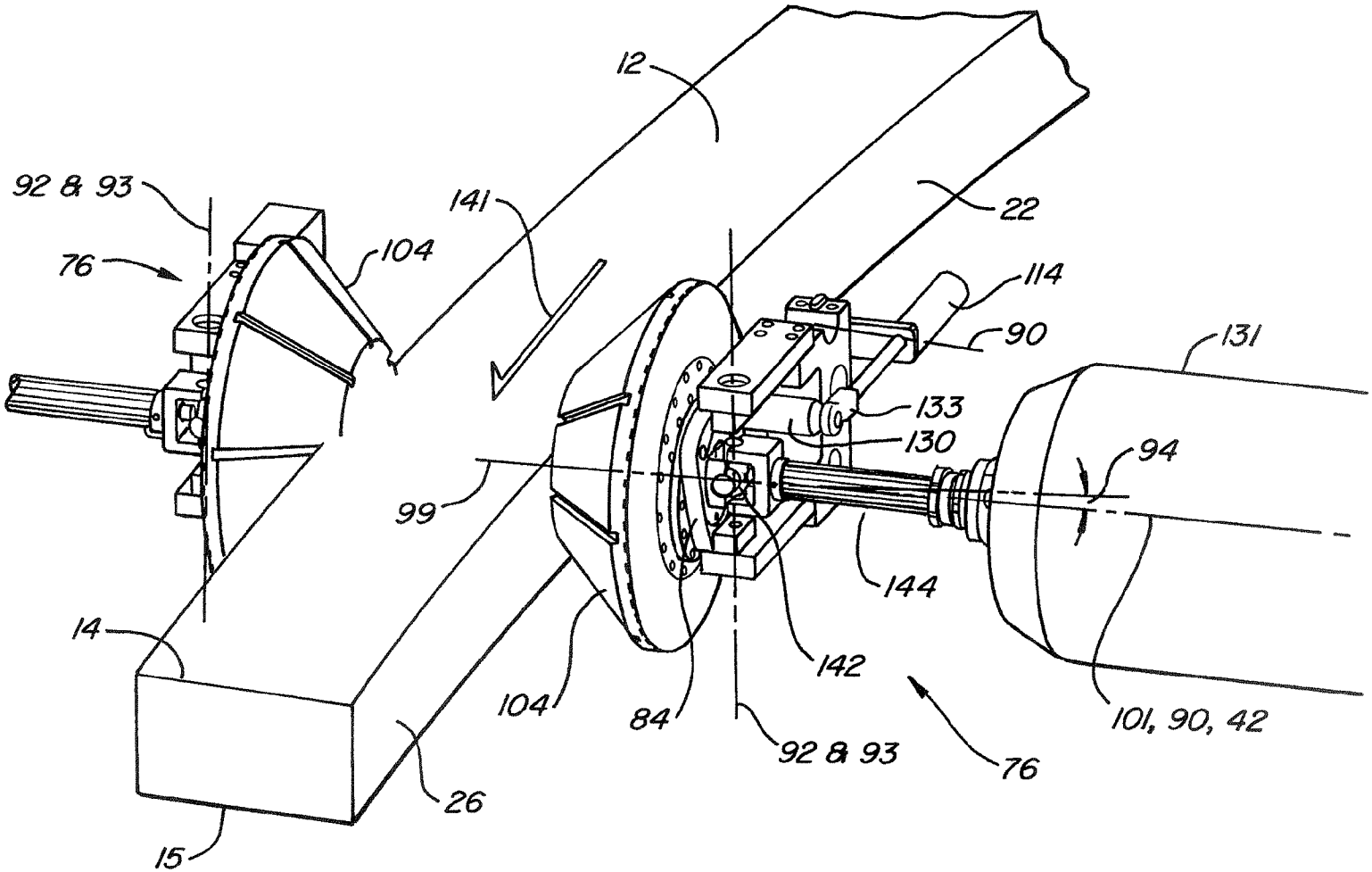
FIG. 27 is an enlarged view of FIG. 26.

One can envision many alternative applications of the saw assembly 56 of FIG. 9 for positioning different cutting tools used in the manufacture of lumber and wood products. One such application is shown in FIGS. 26 and 27. In FIG. 26, a center cant 12 is fed along feed path 141 through a pair of chipper heads 104 that removes sides 22 of center cant 12 leaving square edge chipped face 26 on the sides of center cant 12. As center cant 12 is fed along feed path 141, the two chipper heads 104 rotating about spindle axis 99 cut the edge 22 off of center cant 12 leaving chipped face 26. As the cant 12 feeds along the feed path 141 the chip heads 104 are constantly positioned both side to side along shift shaft axis 90 and angularly about each axis 92 of saw positioners 76 in order to produce a uniform cut along the sides of center cant 12. In this application, the chip heads 104 have replaced the saw blades 75 on the saw spindle 74. The spindle rotation axis 99 is positioned angularly by the actuation of skewing positioner 114 coupled directly to ball joint 133 which is connected to steering arm 130 causing spindle housing 84 to pivot about vertical pivot axis 92. In this application each positioner assembly 76 has a skewing positioner 114 to allow the angle 94 of the each spindle axis to be adjusted independently depending on the profile of center cant 12.

Figure 28:
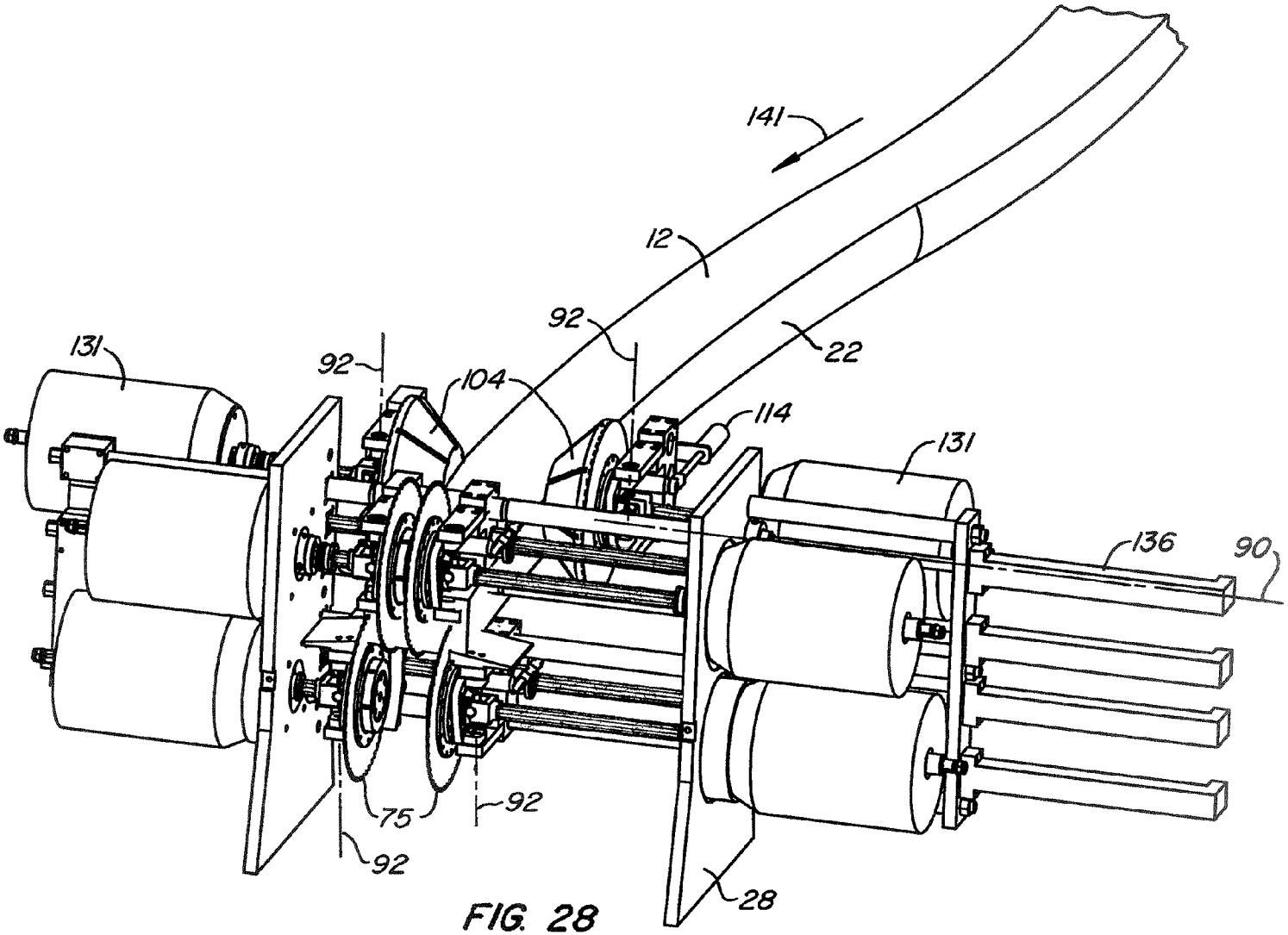
FIG. 28 is an isometric view of an assembly of six of the saw positioners of FIG. 21 with two positioners having the saws replaced with chip heads shown chipping and sawing a center cant.

An additional turn of the application is shown in FIG. 28. In this application, center cant 12 is fed along feed path 141 through a pair of chipper heads 104 and on into a set of four saw blades causing the center cant 12 to be processed into finished square edged lumber. As center cant 12 is being fed along feed path 141, chipper heads 104 and saw blades 75 are constantly positioned both side to side along shift shaft axis 90 and angularly about vertical pivot axis 92. The angles 94 of both chipper head rotation axes 99 are adjusted independently by skew positioners 114 allowing each chipper head to follow the edge 22 of center cant 12.

Figure 29:
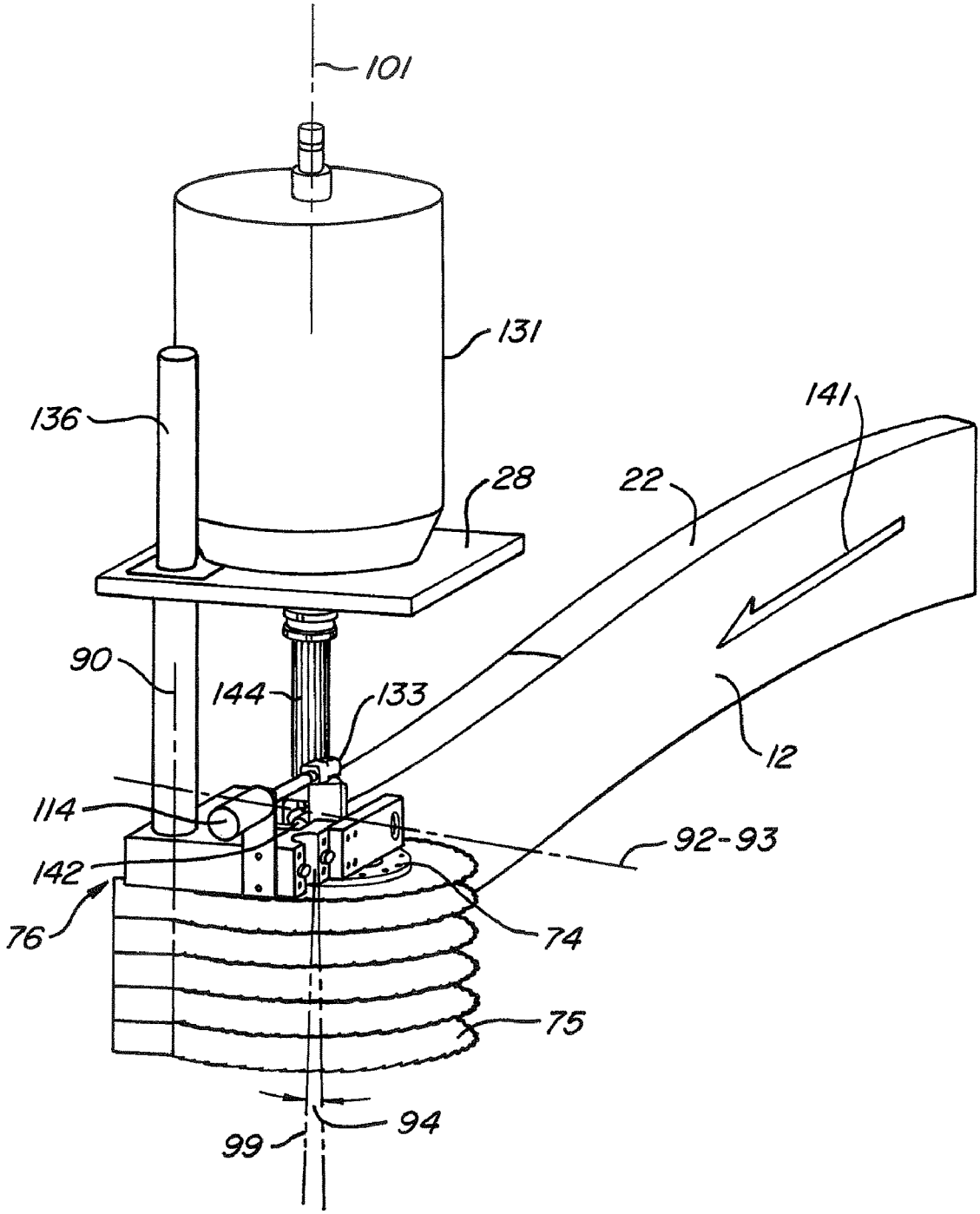
FIG. 29 is an isometric view of the saw assembly of FIG. 21 having a plurality of saw blades cutting a center cant in the vertical plane.

FIG. 29 shows another alternative application of the saw blade positioner 76 of FIG. 9. In this application, the single saw blade 75 has been replaced by a plurality of saw blades 75 to provide multiple cut lines 18 on center cant 12 as center cant 12 is fed through the saw blades 75 along feed path 41. In this application the saw spindle axis is generally in the vertical position. As center cant 12 is being fed through the saw blades 75 skewing actuator 114 and linear actuator 136 constantly position both the angle 94 of the saw spindle about spindle pivot housing pivot axis 92 and the vertical position of the saws 75 relative to the profile of center cant 12 as is passes through saws 75. In this example spindle 74 is an extended length spindle and the sawblades 75 are mounted to the extended length spindle with a desired thickness spacer between the sawblades to cut the desired width of finished lumber. The sawblades are held onto the extended length spindle with a nut at the end of the spindle.

FIG. 29 shows the axis 99 of saw spindle 74 in roughly a vertical position. This same gang assembly could also have the saw spindle axis 99 in roughly a horizontal position. There are an unlimited number of applications for using an extendable universal joint driveline to drive the different cutting tools used in the manufacture of lumber and other wood products. Using an extendable universal joint driveline to drive the cutting tool allows the drive motor to stay fixed reducing the mass that has to be positioned to that of the saw positioner 76 and the actual cutting tools. This reduced mass allows the cutting tools of saw positioner 76 to be positioned faster than conventional cutting tools that are positioned with the drive motor and motor mounting base.

The above descriptions may have used terms such as above, below, top, bottom, over, under, et cetera. These terms are used to aid understanding of the invention are not used in a limiting sense.

Figure 20:
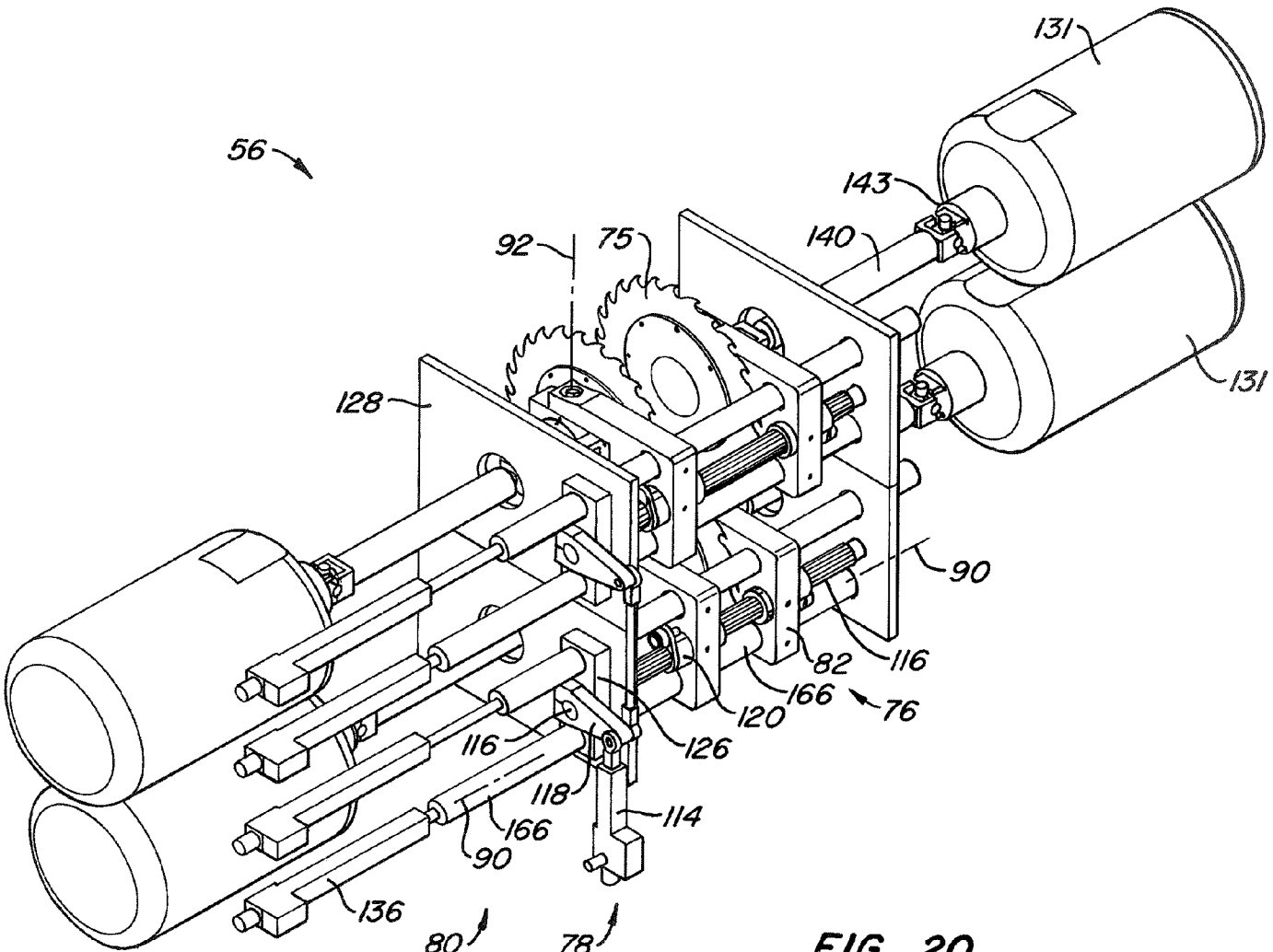
FIG. 20 is an isometric view of an assembly of four saw positioner assemblies of FIG. 9.
Figure 21:
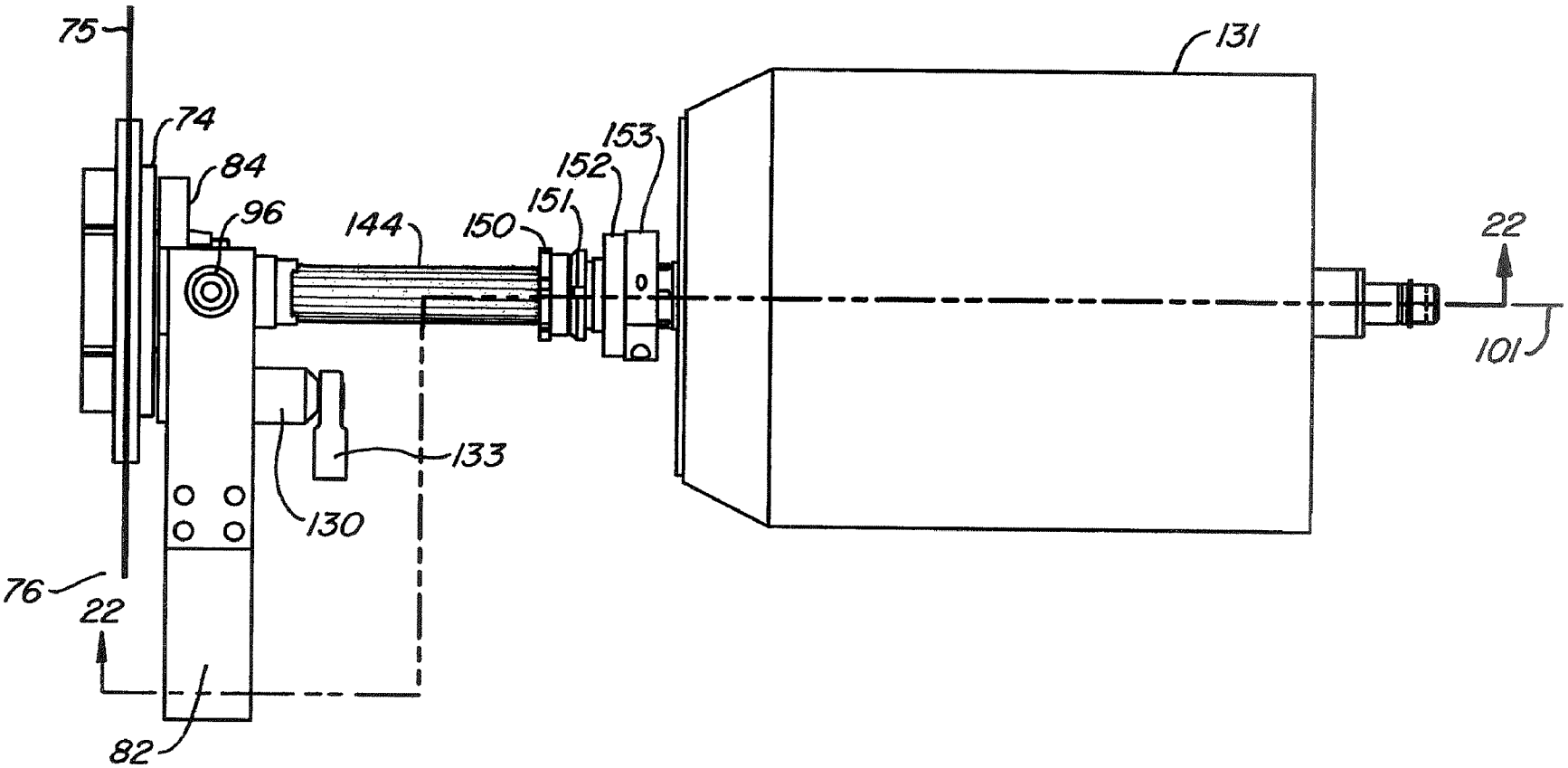
FIG. 21 is a top view of the saw assembly of FIG. 9 showing an alternate drive assembly for the spindle.
Figure 22:
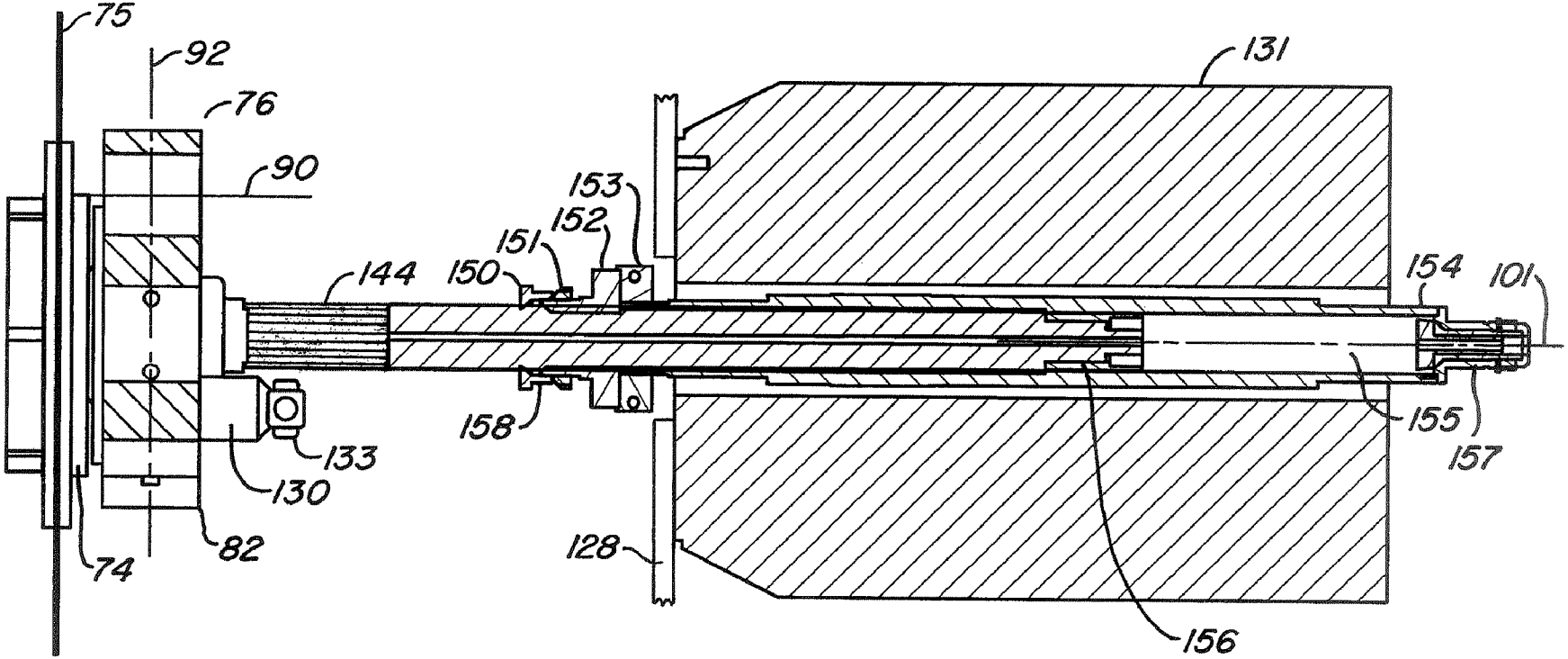
FIG. 22 is a section view 22-22 of the alternate saw drive assembly shown in FIG. 21.
Figure 23:
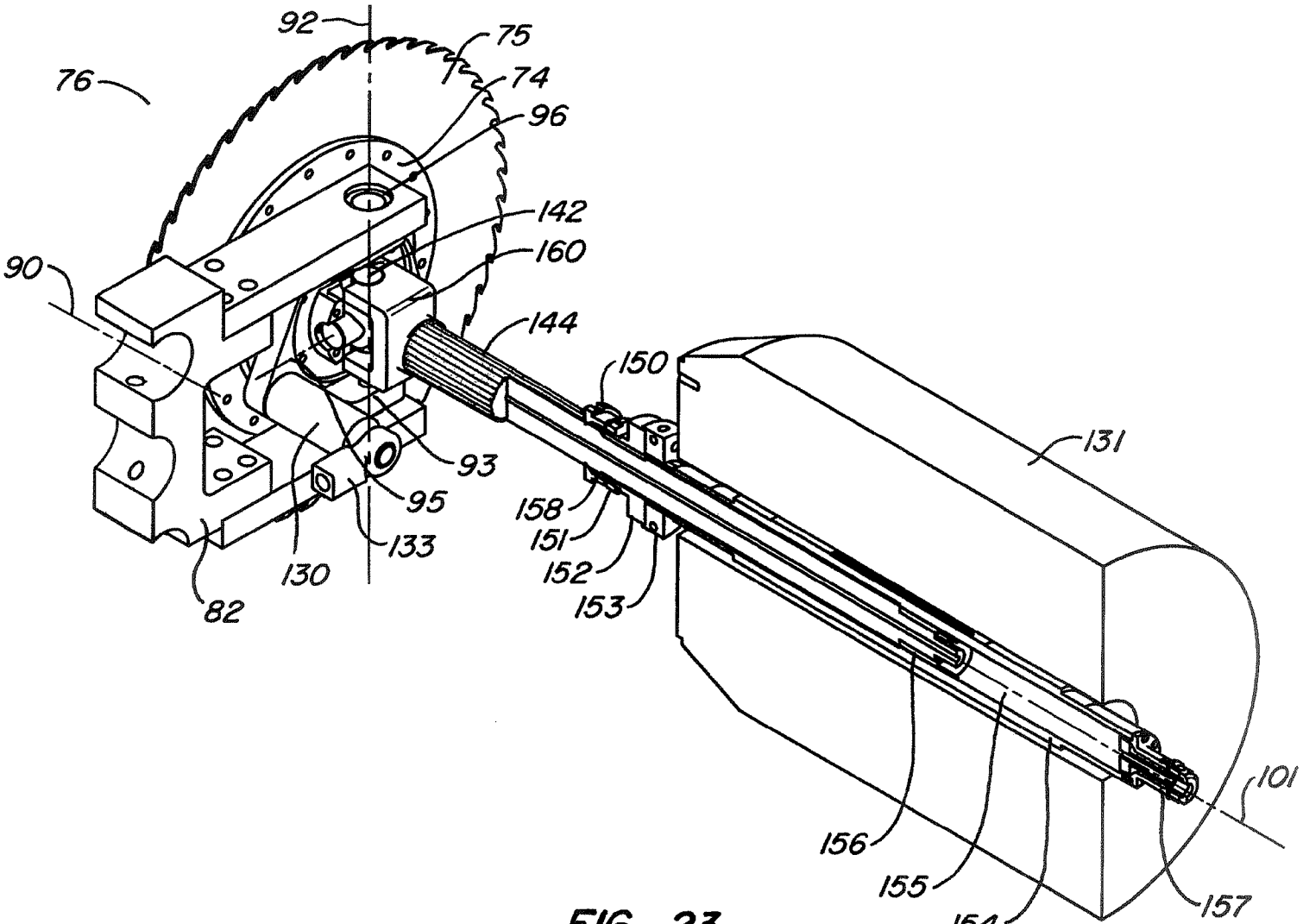
FIG. 23 is an isometric view of the alternate saw drive assembly section view of FIG. 22.
Figure 24:
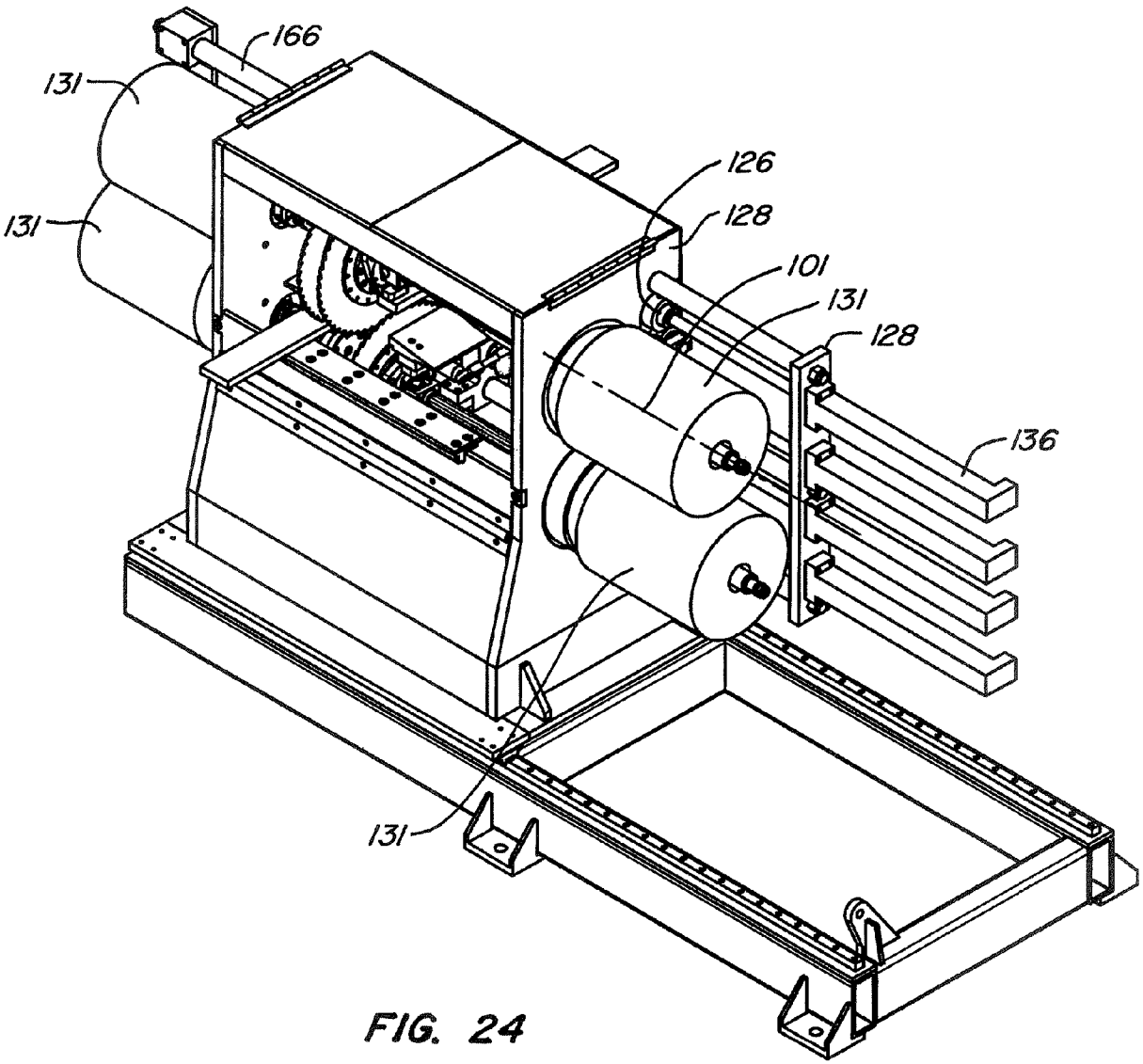
FIGS. 24 and 25 are an isometric and front view of the alternate saw drive assembly of FIG. 21 showing a set of four assemblies configured on a frame.
Figure 25:
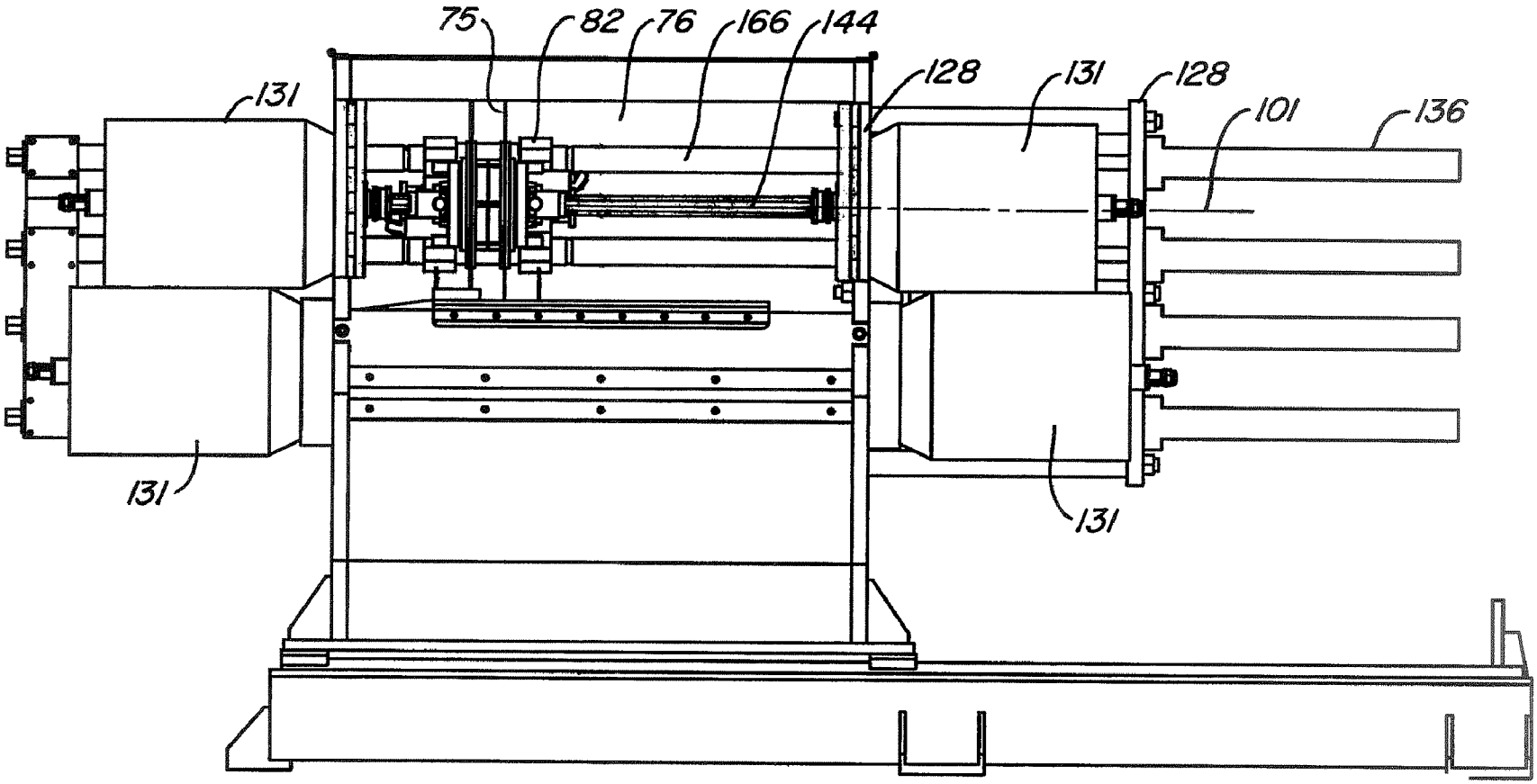

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims. For example, the proportions and numbers of center cant 12, center cant lumber 20, side boards 4, and side board lumber 24 illustrated in FIGS. 2-6 are simply one example for one particular log 2; some logs may produce no side board lumber. Extendable drive line 140 could use constant velocity joints instead of universal joints to transmit power to the saw spindle 74. Different configurations of the invention can be used to allow varying numbers of saw blade positioners 76. FIG. 20 shows one configuration using four saw blade positioners 76.

Any and all patents, patent applications and printed publications referred to above are incorporated by reference.

What is claimed is:

1. A wood product assembly comprising:

a frame;

a cutter subassembly supported by the frame and comprising:

a slewing assembly having a slewing axis;

a cutter positioning body secured to and movable by the slewing assembly for movement along the slewing axis;

a spindle housing mounted to the cutter positioning body for pivotal movement about a pivot axis;

a cutter driver;

a spindle mounted to the spindle housing for rotation about a spindle rotation axis, the spindle connected to and rotatable by the cutter driver; and a cutter affixed to and movable with the spindle; and a skewing assembly supported by the frame and coupled to the spindle housing and operable to position the spindle rotation axis to a selected angular orientation over a range of angular orientations thereby positioning the cutter at a selected skew angle.

2. The assembly according to claim 1 wherein the cutter comprises a saw blade.

3. The assembly according to claim 1 wherein the cutter comprises a chipper head.

4. The assembly according to claim 1 further comprising a plurality of the cutter subassemblies and a cutter driver for each said cutter subassembly.

5. The assembly according to claim 4 wherein the skewing assembly is coupled to the spindle housing of each of the cutting subassemblies and is operable to position, in unison, each of the saw spindle rotation axes of the respective spindles to said selected angular orientation thereby positioning, in unison, each of the cutters at said selected skew angle.

6. The assembly according to claim 4 wherein the cutter driver of each said cutting subassembly comprises a drive motor fixedly supported by the frame and a drive shaft extending from and driven by the drive motor.

7. The assembly according to claim 1 wherein the cutter driver comprises a drive motor fixedly supported by the frame and a drive shaft extending from and driven by the drive motor.

8. The assembly according to claim 7 wherein the spindle is connected to the drive shaft by a drive joint.

9. The assembly according to claim 8 wherein the drive joint has a rotational center and the drive joint is positioned with the pivot axis passing through the rotational center of the drive joint.

10. The assembly according to claim 8 wherein the drive joint has a rotational center and the drive joint is positioned with the pivot axis spaced apart from the rotational center of the drive joint.

11. The assembly according to claim 1 wherein the cutter driver comprises:

a drive source fixedly secured to the frame; and an extendable length universal joint driveline assembly connecting the drive source to the spindle to transmit torque to the spindle while allowing both: [1] the spindle rotation axis to turn at an angle relative to the drive source, and [2] the spindle to move closer to or further away from the drive source.

12. The assembly according to claim 11 wherein the extendable length universal joint driveline assembly comprises a universal drive joint and a slip joint.

13. A wood product assembly comprising:

a frame;

a cutter subassembly supported by the frame and comprising:

a slewing assembly having a slewing axis;

a cutter positioning body secured to and movable by the slewing assembly for movement along the slewing axis;

a spindle housing mounted to and supported by the cutter positioning body for pivotal movement about a pivot axis;

a cutter driver;

a spindle mounted to the spindle housing for rotation about a spindle rotation axis, the spindle connected to and rotatable by the cutter driver; and a cutter affixed to and movable with the spindle; and a skewing assembly supported by the frame and coupled to the spindle housing and operable to position the spindle rotation axis to a selected angular orientation over a range of angular orientations thereby positioning the cutter at a selected skew angle;

the slewing assembly comprising a shift shaft defining the slewing axis and a shift shaft positioner operable to position the shift shaft at positions along the slewing axis; and the cutter positioning body being secured to and movable with the shift shaft along the slewing axis.

14. A method for slewing and skewing a cutter while the cutter cuts a log moving along a feed path comprising:

accessing a cutter affixed to and supported by a housing for rotation about a rotation axis, the rotation axis passing through the cutter and the housing, the housing pivotally mounted to a cutter positioner for pivotal movement of the housing and cutter therewith about a pivot axis;

slewing the cutter by positioning the housing and cutter therewith along a cutter shift axis, the cutter shift axis being transverse to a feed path of a log;

skewing the cutter by pivoting the housing and cutter therewith about the pivot axis; and rotating the cutter about the rotation axis passing through the cutter and the housing.

15. The method according to claim 14 wherein the accessing step is carried out with the cutter being a saw blade assembly including a saw blade and an integral saw spindle, the saw blade being fixedly secured to the saw spindle, the saw spindle rotatably mounted within an opening in the housing.

16. The method according to claim 14 wherein:

the pivotally mounting step is carried out with the cutter positioner comprising a cutter positioning body, to which the housing is pivotally mounted; and the slewing step comprises positioning the cutter positioner body at positions along the cutter shift axis.

17. The method according to claim 16 wherein:

the skewing step is carried out using skewing linkage mounted to the cutter positioning body and operably connected to the housing.

18. The method according to claim 17 wherein the skewing step is carried out by rotating a skewing drive shaft, the skewing drive shaft drivingly coupled to the skewing linkage.

19. The method according to claim 14 wherein the cutter rotating step comprises rotating a drive line connected to the cutter by a drive joint.

20. The method according to claim 14 wherein the cutter rotating step comprises rotating a drive line connected to the cutter by a drive joint, the drive joint having a rotational center, the pivot axis passing through the rotational center.

21. The method according to claim 14 wherein the cutter rotating step comprises rotating a drive line connected to the cutter by a drive joint, the drive joint having a rotational center, the pivot axis spaced apart from the rotational center.

22. The method according to claim 14 wherein:

the accessing step is carried out with the cutter being a saw blade having annular side surfaces; and the slewing and the skewing steps are carried out without sliding contact by a guide member with the annular side surfaces.

23. The assembly according to claim 1 wherein:

the cutter is a saw blade having annular side surfaces; and the slewing assembly and the skewing assembly are constructed so as not to be in sliding contact with the annular side surfaces.

* * * * *